US010474065B2

(12) United States Patent
Mimura

(10) Patent No.: US 10,474,065 B2
(45) Date of Patent: Nov. 12, 2019

(54) TONER CASE INCLUDING ROTATOR ROTATING AROUND ROTATION AXIS AND COVER MOVING ALONG ROTATION AXIS DIRECTION OF ROTATOR AND IMAGE FORMING APPARATUS INCLUDING THE SAME

(71) Applicant: KYOCERA Document Solutions Inc., Osaka (JP)

(72) Inventor: Daisuke Mimura, Osaka (JP)

(73) Assignee: KYOCERA Documents Solutions Inc., Osaka (JP)

( * ) Notice: Subject to any disclaimer, the term of this patent is extended or adjusted under 35 U.S.C. 154(b) by 0 days.

(21) Appl. No.: 15/858,565

(22) Filed: Dec. 29, 2017

(65) Prior Publication Data

US 2018/0203382 A1 Jul. 19, 2018

(30) Foreign Application Priority Data

Jan. 17, 2017 (JP) ..... 2017-005910

(51) Int. Cl.
*G03G 15/08* (2006.01)
*G03G 15/00* (2006.01)

(52) U.S. Cl.
CPC ..... *G03G 15/0889* (2013.01); *G03G 15/0877* (2013.01); *G03G 15/0886* (2013.01); *G03G 15/657* (2013.01); *G03G 2215/00679* (2013.01)

(58) Field of Classification Search
CPC ..... G03G 15/0886; G03G 15/0672; G03G 15/0879; G03G 15/0839; G03G 21/1647; G03G 15/0865; G03G 15/0875; G03G 15/0877
See application file for complete search history.

(56) References Cited

U.S. PATENT DOCUMENTS 7,751,759 B2 7/2010 Watanabe et al.
2007/0077097 A1 4/2007 Watanabe et al.
2010/0278559 A1* 11/2010 Komatsu ..... G03G 21/1825 399/167

(Continued)

FOREIGN PATENT DOCUMENTS

JP 2001-305841 A 11/2001
JP 2007101710 A 4/2007
KR 20080060738 A 7/2008

OTHER PUBLICATIONS

Extended European Search Report issued by the European Patent Office dated Jun. 12, 2018, which corresponds to EP17210756.7-1022 and is related to U.S. Appl. No. 15/858,565.

(Continued)

*Primary Examiner* — Walter L Lindsay, Jr.
*Assistant Examiner* — Jessica L Eley
(74) *Attorney, Agent, or Firm* — Studebaker & Brackett PC

(57) ABSTRACT

A toner case includes a case main body, a rotator, a transmitter and a cover. The case main body stores a toner. The rotator is stored in the case main body and rotates around a rotation axis. The transmitter transmits rotation to the rotator. At least apart of the transmitter is arranged outside the case main body. The cover moves along a rotation axis direction of the rotator between a covering position where the cover covers an outer circumference of the transmitter and an exposing position where the cover exposes the transmitter.

11 Claims, 17 Drawing Sheets

(56) References Cited

U.S. PATENT DOCUMENTS

| | | | | |
|---|---|---|---|---|
| 2012/0003000 | A1* | 1/2012 | Nishiyama | G03G 15/0896 399/110 |
| 2013/0170845 | A1* | 7/2013 | Itabashi | G03G 15/757 399/12 |
| 2015/0005134 | A1* | 1/2015 | Shimizu | F16H 13/04 476/67 |
| 2015/0117907 | A1* | 4/2015 | Fujii | G03G 15/0887 399/262 |
| 2015/0192880 | A1* | 7/2015 | Noda | G03G 15/0889 399/12 |

OTHER PUBLICATIONS

An Office Action mailed by the Japanese Patent Office dated Sep. 3, 2019, which corresponds to Japanese Patent Application No. 2017-005910 and is related to U.S. Appl. No. 15/858,565.

* cited by examiner

TONER CASE INCLUDING ROTATOR ROTATING AROUND ROTATION AXIS AND COVER MOVING ALONG ROTATION AXIS DIRECTION OF ROTATOR AND IMAGE FORMING APPARATUS INCLUDING THE SAME

INCORPORATION BY REFERENCE

This application is based on and claims the benefit of priority from Japanese patent application No. 2017-005910 filed on Jan. 17, 2017, which is incorporated by reference in its entirety.

BACKGROUND

The present disclosure relates to a toner case and an image forming apparatus including the toner case.

An image forming apparatus, such as a printer, a copying machine, a facsimile and a multifunctional peripheral, includes a toner case which replenishes a developing device with a toner (a developer). For instance, the toner case includes a case main body storing the toner, a rotator stored in the case main body and rotating around a rotation axis and a transmitter arranged outside the case main body and transmitting rotation to the rotator. In such a toner case, by transmitting the rotation from the transmitter to the rotator, the toner in the case main body is agitated or conveyed by the rotator.

SUMMARY

In accordance with an aspect of the present disclosure, a toner case includes a case main body, a rotator, a transmitter and a cover. The case main body stores a toner. The rotator is stored in the case main body and rotates around a rotation axis. The transmitter transmits rotation to the rotator. At least a part of the transmitter is arranged outside the case main body. The cover moves along a rotation axis direction of the rotator between a covering position where the cover covers an outer circumference of the transmitter and an exposing position where the cover exposes the transmitter.

In accordance with an aspect of the present disclosure, an image forming apparatus includes the toner case and an attachment part to which the toner case is detachably attached.

The above and other objects, features, and advantages of the present disclosure will become more apparent from the following description when taken in conjunction with the accompanying drawings in which a preferred embodiment of the present disclosure is shown by way of illustrative example.

DETAILED DESCRIPTION

Hereinafter, a multifunctional peripheral 1 (an example of an image forming apparatus) according to one embodiment of the present disclosure will be described. Arrows Fr, Rr, L, R, U and Lo shown in each figure respectively indicate a front side, a rear side, a left side, a right side, an upper side and a lower side of the multifunctional peripheral 1.

Firstly, an entire structure of the multifunctional peripheral 1 will be described.

Figure 1:
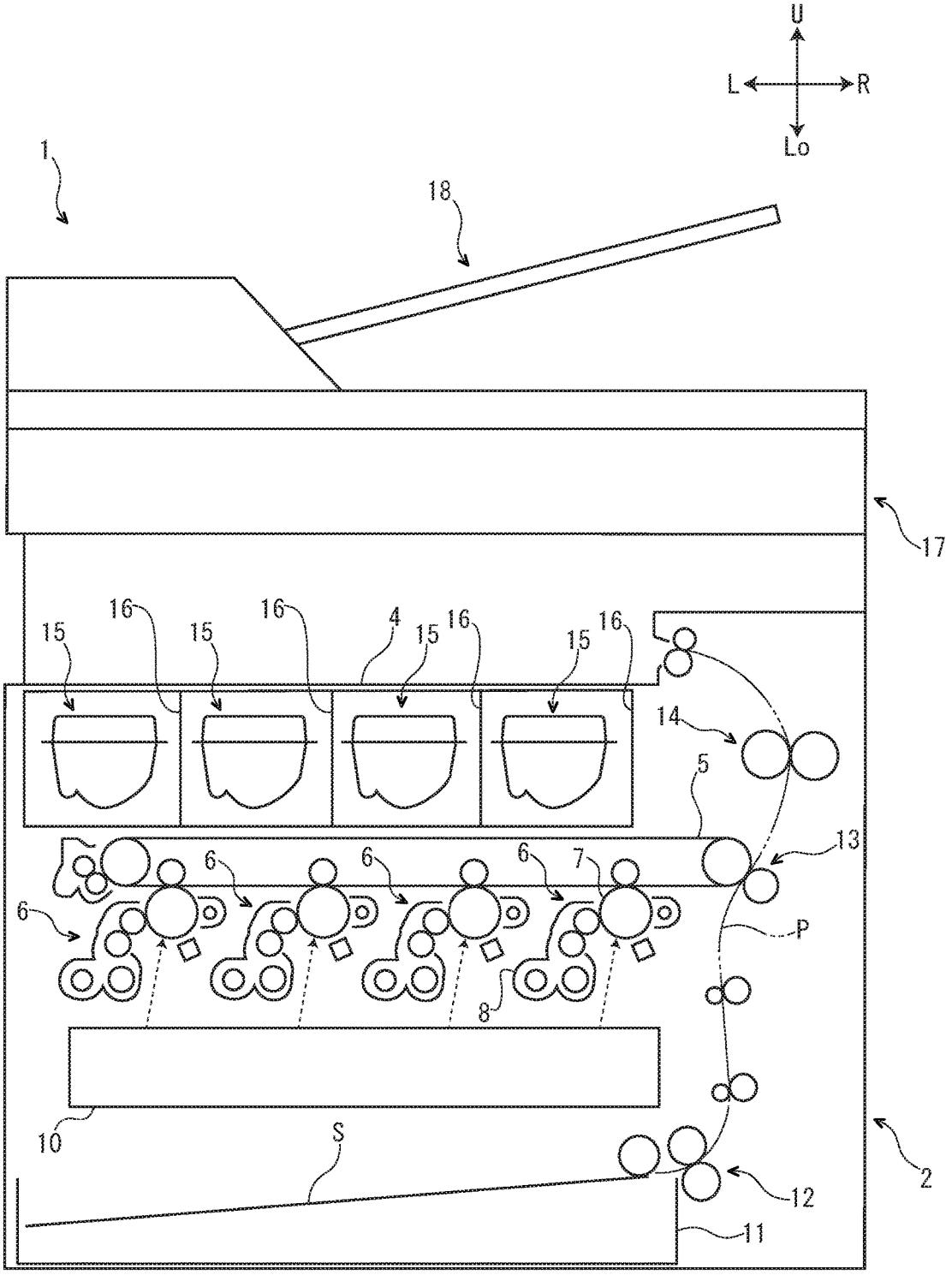
FIG. 1 is a schematic view showing a multifunctional peripheral according to one embodiment of the present disclosure.

With reference to FIG. 1, the multifunctional peripheral 1 includes a box-shaped multifunctional peripheral main body 2 (an example of an apparatus main body). In an upper portion of the multifunctional peripheral main body 2, an ejected sheet tray 4 is provided. In an approximate center portion of the multifunctional peripheral main body 2, an intermediate transferring belt 5 and four image forming parts 6 are stored. The four image forming parts 6 correspond to four colors, for example, black, cyan, magenta and yellow, of a toner (a developer). Each image forming part 6 includes a photosensitive drum 7 (an example of an image carrier) and a developing device 8. In a lower portion of the multifunctional peripheral main body 2, an exposing device 10 is stored. In a lower end portion of the multifunctional peripheral main body 2, a sheet feeding cassette 11 storing a sheet S (an example of a recording medium) is stored.

In a right side portion of the multifunctional peripheral main body 2, a conveying path P for the sheet S is provided. At an upstream end of the conveying path P, a sheet feeding part 12 is provided. At a middle portion of the conveying path P, a secondary transferring part 13 is provided. At a downstream portion of the conveying path P, a fixing device 14 is provided.

In the upper portion of the multifunctional peripheral main body 2, four toner containers 15 (an example of a toner case) are stored below the ejected sheet tray 4. The toner containers 15 correspond to the four colors, for example, black, cyan, magenta and yellow, of the toner (the developer). The four toner containers 15 are detachably attached to four attachment parts 16 provided in the upper portion of the multifunctional peripheral main body 2.

At an upper end portion of the multifunctional peripheral main body 2, an image reading device 17 configured to read an image of a document is provided. Above the image reading device 17, a document conveying device 18 configured to convey the document automatically to an image reading position of the image reading device 17 is provided.

Next, an operation of the multifunctional peripheral 1 will be described.

Firstly, light (refer to a dot line arrow in FIG. 1) emitted from the exposing device 10 exposes the photosensitive drum 7 of each image forming part 6 to form an electrostatic latent image on the photosensitive drum 7. The electrostatic latent image is developed by the developing device 8 of each image forming part 6. Thereby, a toner image is carried on the photosensitive drum 7. The toner image is primarily transferred from the photosensitive drum 7 of each image forming part 6 to the intermediate transferring belt 5. Thereby, a full color toner image is formed on the intermediate transferring belt 5.

On the other hand, the sheet S fed from the sheet feeding cassette 11 by the sheet feeding part 12 is conveyed to a downstream side along the conveying path P and enters the secondary transferring part 13. At the secondary transferring part 13, the full color toner image formed on the intermediate transferring belt 5 is secondarily transferred to the sheet S. The sheet S on which the toner image is secondarily transferred is further conveyed to the downstream side along the conveying path P and enters the fixing device 14. The fixing device 14 fixes the toner image on the sheet S. The sheet S on which the toner image is fixed is ejected on the ejected sheet tray 4.

Next, the four toner containers 15 will be described in detail. The four toner containers 15 have the same configuration, and, therefore, one of the toner containers 15 will be described and other toner containers will not be described. An arrow O shown in each figure after FIG. 2 indicates an outside in the front-and-rear direction of the toner container 15, and an arrow I shown in each figure after FIG. 2 indicates an inside in the front-and-rear direction of the toner container 15.

Figure 2:
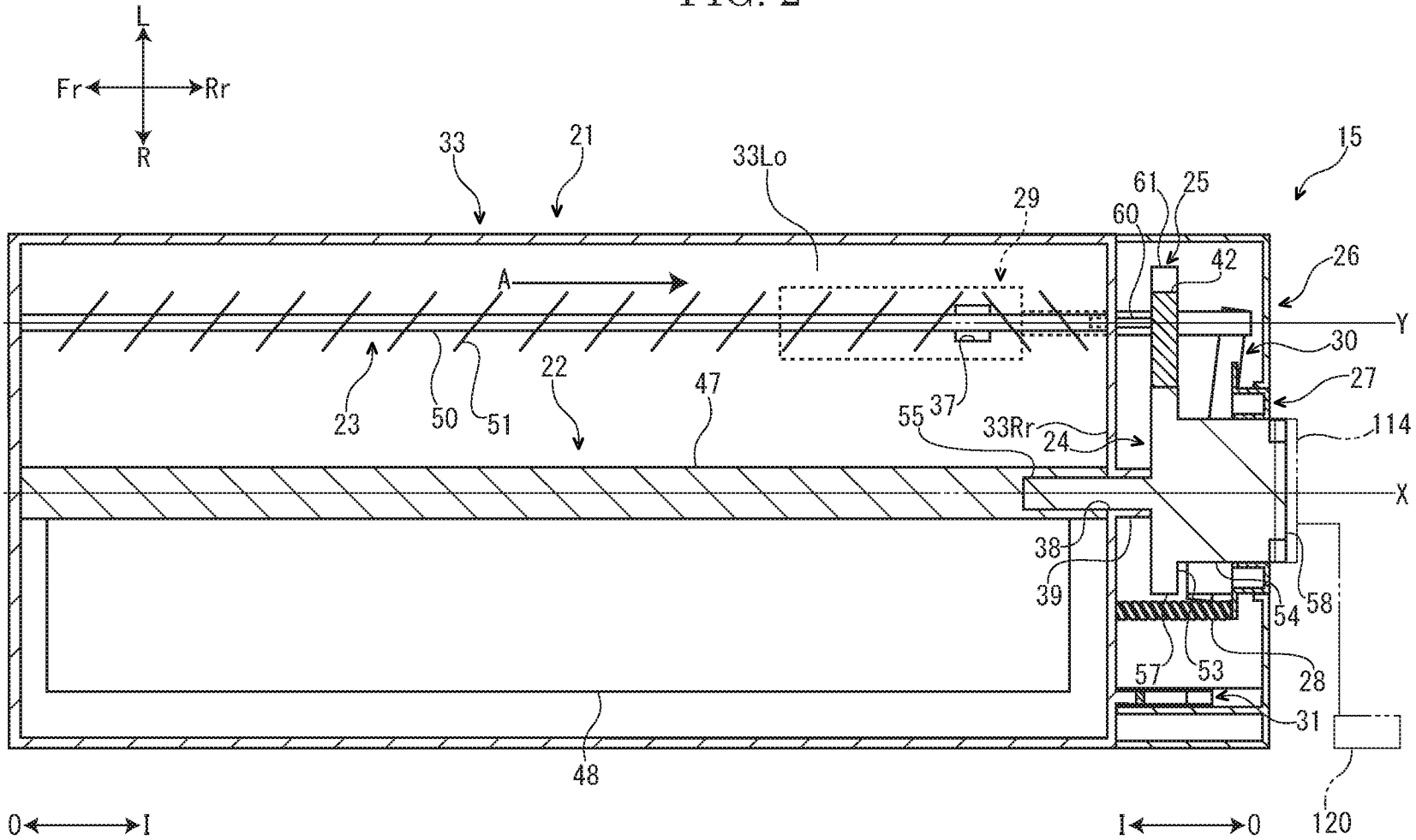
FIG. 2 is a sectional view schematically showing a toner container according to the one embodiment of the present disclosure.

With reference to FIG. 2, the toner container 15 includes a case main body 21, an agitator 22 (an example of a rotator) stored in a center portion of the case main body 21, a conveyer 23 (an example of a rotator) stored in a left lower portion of the case main body 21, a transmitter 24 arranged at a rear end side of the case main body 21, a connector 25 arranged at a left lower side of the transmitter 24, a holder 26 partially covering a rear side (the outside in the front-and-rear direction) of the case main body 21, a cover 27 arranged at a center of the holder 26, a pair of left and right coil springs 28 (an example of a biasing member, only the right coil spring 28 is shown in FIG. 2) arranged between the case main body 21 and the cover 27, a shutter 29 arranged at a left lower side of a rear portion of the case main body 21, a link 30 arranged at a lower side of the transmitter 24 and a restriction member 31 arranged at a right side of the transmitter 24.

Figure 3:
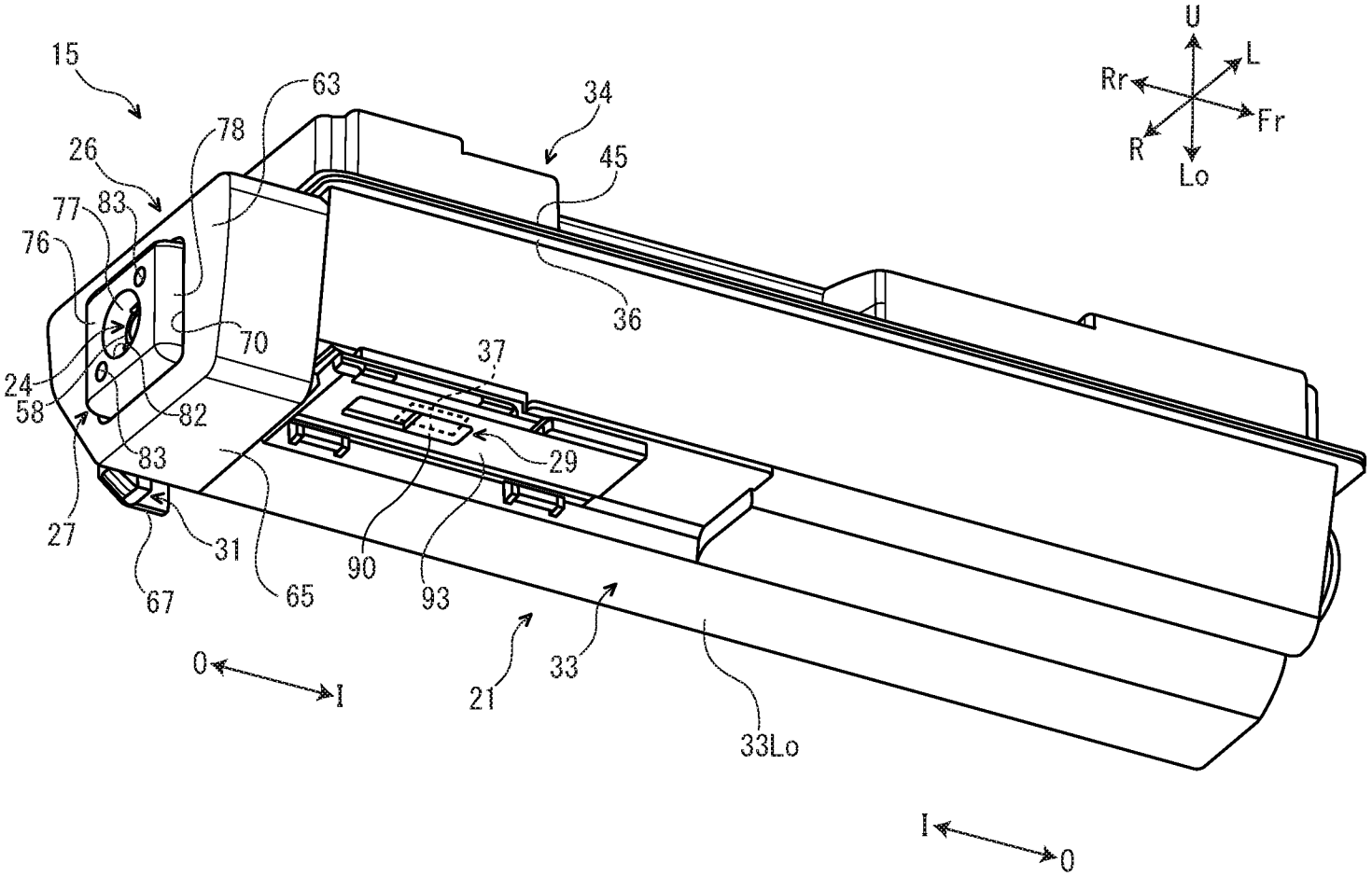
FIG. 3 is a perspective view showing a state where a cover is in a covering position and a shutter is in a closing position, in the toner container according to the one embodiment of the present disclosure.
Figure 4:
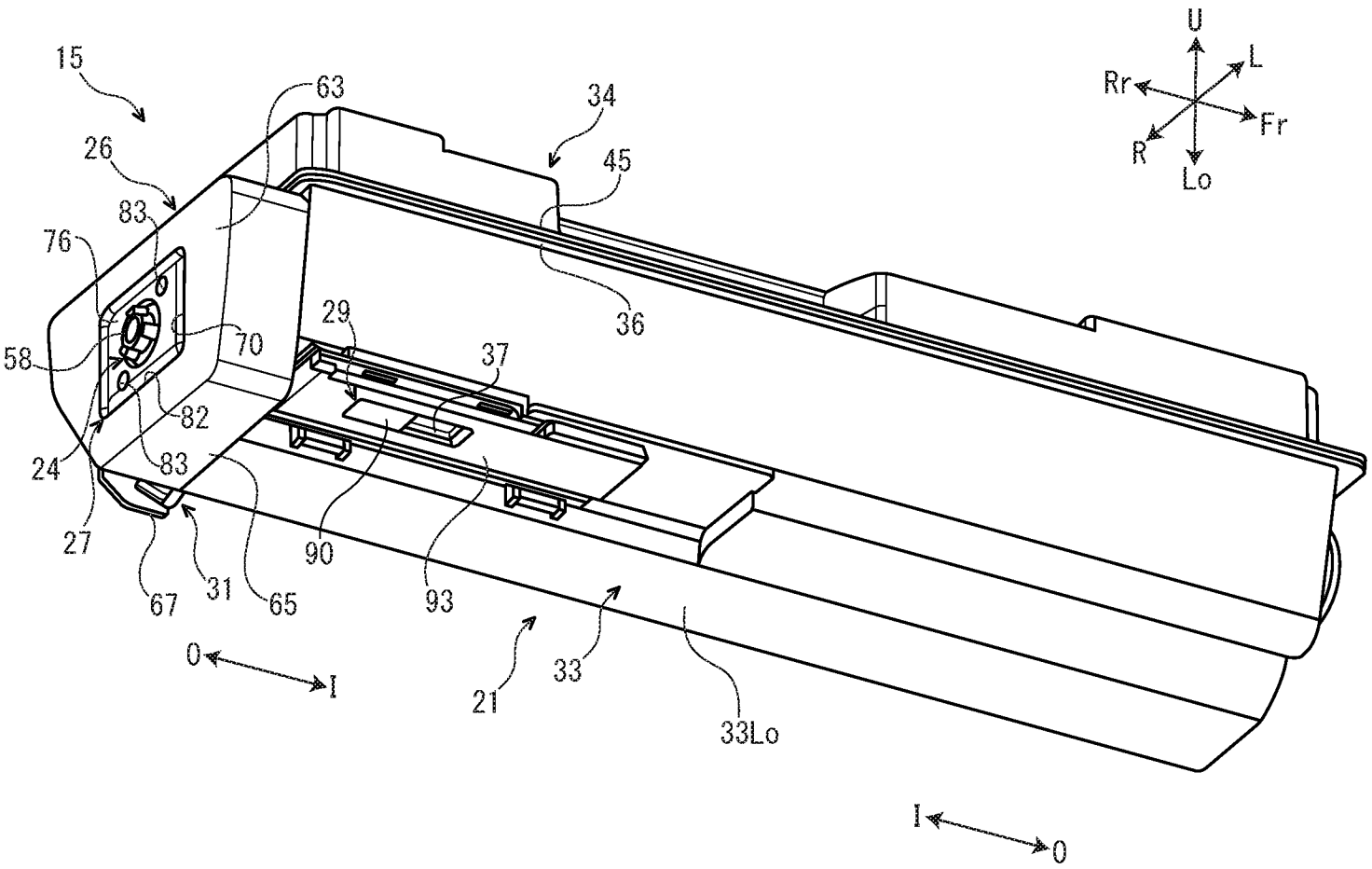
FIG. 4 is a perspective view showing a state where the cover is in an exposing position and the shutter is in an opening position, in the toner container according to the one embodiment of the present disclosure.

With reference to FIG. 3 and FIG. 4, the case main body 21 has a shape elongated in the front-and-rear direction. The case main body 21 stores the toner (the developer). The case main body 21 includes a storage 33 and a lid 34 provided at an upper side of the storage 33.

Figure 5:
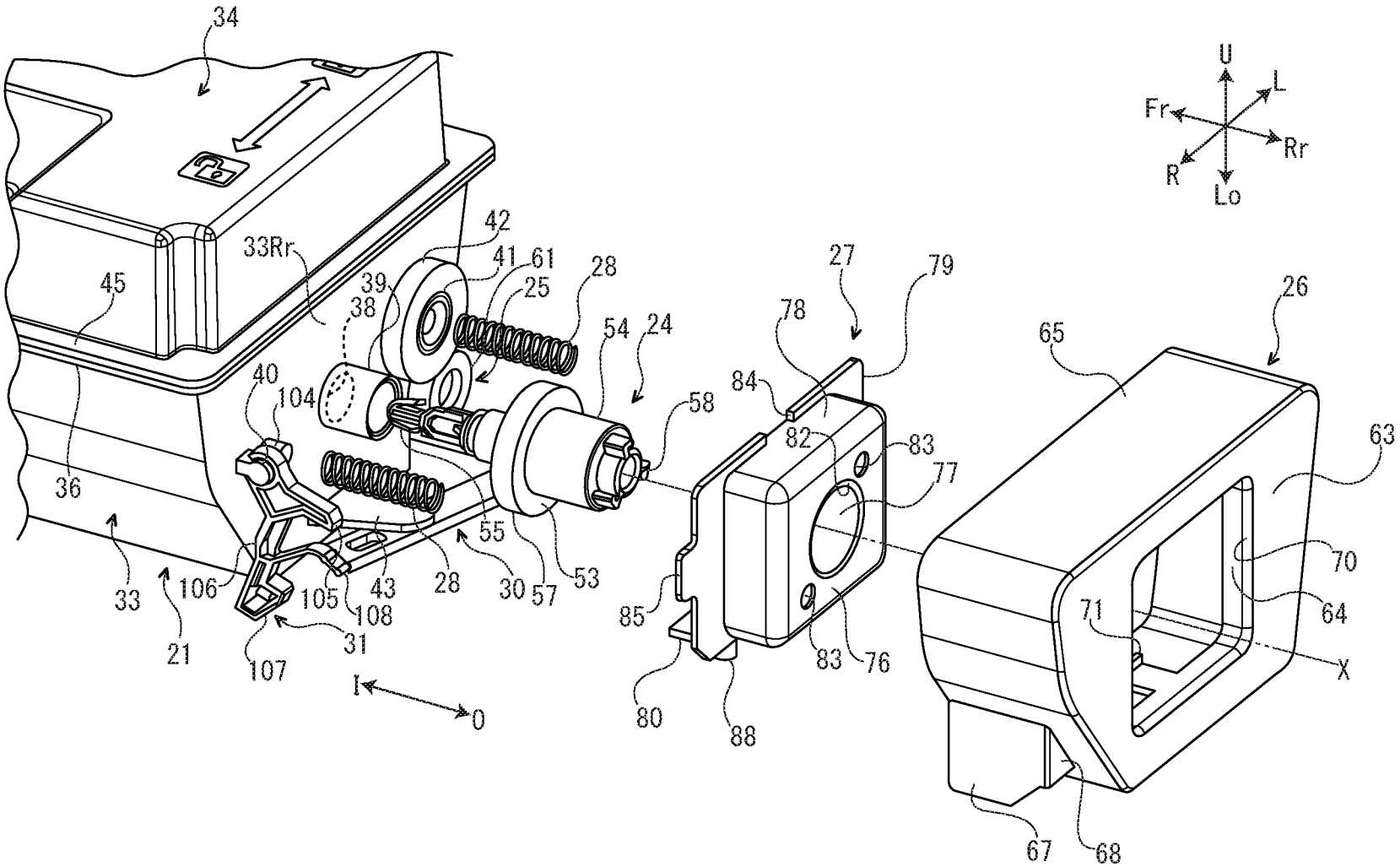
FIG. 5 is a disassembled perspective view showing the toner container according to the one embodiment of the present disclosure, when viewed from a right rear side.

The storage 33 of the case main body 21 is formed in a box-like shape whose upper side is opened. Around an upper end of an outer circumference of the storage 33, a lower side flange 36 is provided. In a left rear portion of a bottom wall 33Lo of the storage 33, a discharge port 37 through which the toner is discharged is provided. With reference to FIG. 5, in a center portion of a rear side wall 33Rr of the storage 33, a communication hole 38 is provided. On the center portion of the rear side wall 33Rr of the storage 33, a communication cylinder 39 is protruded from an outer circumference of the communication hole 38 to the rear side (the outside in the front-and-rear direction). On a right side portion of the rear side wall 33Rr of the storage 33, a mounting projection 40 is protruded to the rear side (the outside in the front-and-rear direction). On a left upper portion of the rear side wall 33Rr of the storage 33, a cylindrical bearing 41 is protruded to the rear side (the outside in the front-and-rear direction). The bearing 41 rotatably supports an idle gear 42. On a lower portion of the rear side wall 33Rr of the storage 33, a supporting plate 43 is protruded to the rear side (the outside in the front-and-rear direction).

The lid 34 of the case main body 21 is formed in a box-like shape whose lower side is opened. Around a lower end of an outer circumference of the lid 34, an upper side flange 45 is provided. The upper side flange 45 is fixed to the lower side flange 36 of the storage 33. Thereby, the lid 34 is integrated with the storage 33. An inner space of the lid 34 is communicated with an inner space of the storage 33.

With reference to FIG. 2, the agitator 22 of the toner container 15 is stored in the storage 33 of the case main body 21. The agitator 22 is rotatable around a first rotation axis X extending along the front-and-rear direction. That is, the front-and-rear direction is a rotation axis direction of the agitator 22 in the present embodiment. The agitator 22 includes an agitating shaft 47 extending along the front-and-rear direction and an agitating blade 48 mounted to the agitating shaft 47. The agitating blade 48 is made of resin film, for example, and formed in a sheet-like shape.

The conveyer 23 of the toner container 15 is stored in the storage 33 of the case main body 21. The conveyer 23 is rotatable around a second rotation axis Y extending along the front-and-rear direction. That is, the front-and-rear direction is a rotation axis direction of the conveyer 23 in the present embodiment. The conveyer 23 includes a conveying shaft 50 extending along the front-and-rear direction and a spiral conveying fin 51 protruding on an outer circumference of the conveying shaft 50.

With reference to FIG. 5, the transmitter 24 of the toner container 15 includes an annular base piece 53, a transmitting piece 54 protruding from a center portion of the base piece 53 to the rear side (the outside in the front-and-rear direction) and a coupling piece 55 protruding from the center portion of the base piece 53 to the front side (the inside in the front-and-rear direction).

The base piece 53 of the transmitter 24 is arranged at the rear side (the outside in the front-and-rear direction) of the case main body 21. That is, the base piece 53 is arranged outside the case main body 21. Around an outer circumferential face of the base piece 53, a transmitting gear 57 is provided.

The transmitting piece 54 of the transmitter 24 is arranged at the rear side (the outside in the front-and-rear direction) of the case main body 21. That is, the transmitting piece 54 is arranged outside the case main body 21. On a rear face (a face at the outside in the front-and-rear direction) of the transmitting piece 54, a transmitting coupling 58 is provided.

With reference to FIG. 2, the coupling piece 55 of the transmitter 24 penetrates through the communication hole 38 and the communication cylinder 39 provided in the rear side wall 33Rr of the storage 33 of the case main body 21. Thereby, the transmitter 24 is rotatably supported by the case main body 21. A tip end portion of the coupling piece 55 is inserted into an inside of the storage 33, and fixed to a rear end portion of the agitating shaft 47 of the agitator 22. Thereby, the transmitter 24 is connected to the agitator 22, and rotatable integrally with the agitator 22 around the first rotation axis X.

The connector 25 of the toner container 15 includes a connecting shaft 60 and a connecting gear 61 provided around an outer circumference of the connecting shaft 60. The connecting shaft 60 penetrates through the rear side wall 33Rr of the storage 33 of the case main body 21, and is fixed to a rear end portion of the conveying shaft 50 of the conveyer 23. The connecting gear 61 is connected to the transmitting gear 57 of the transmitter 24 via the idle gear 42. According to the above described configuration, the transmitter 24 is connected to the conveyer 23 via the idle gear 42 and the connector 25.

Figure 6:
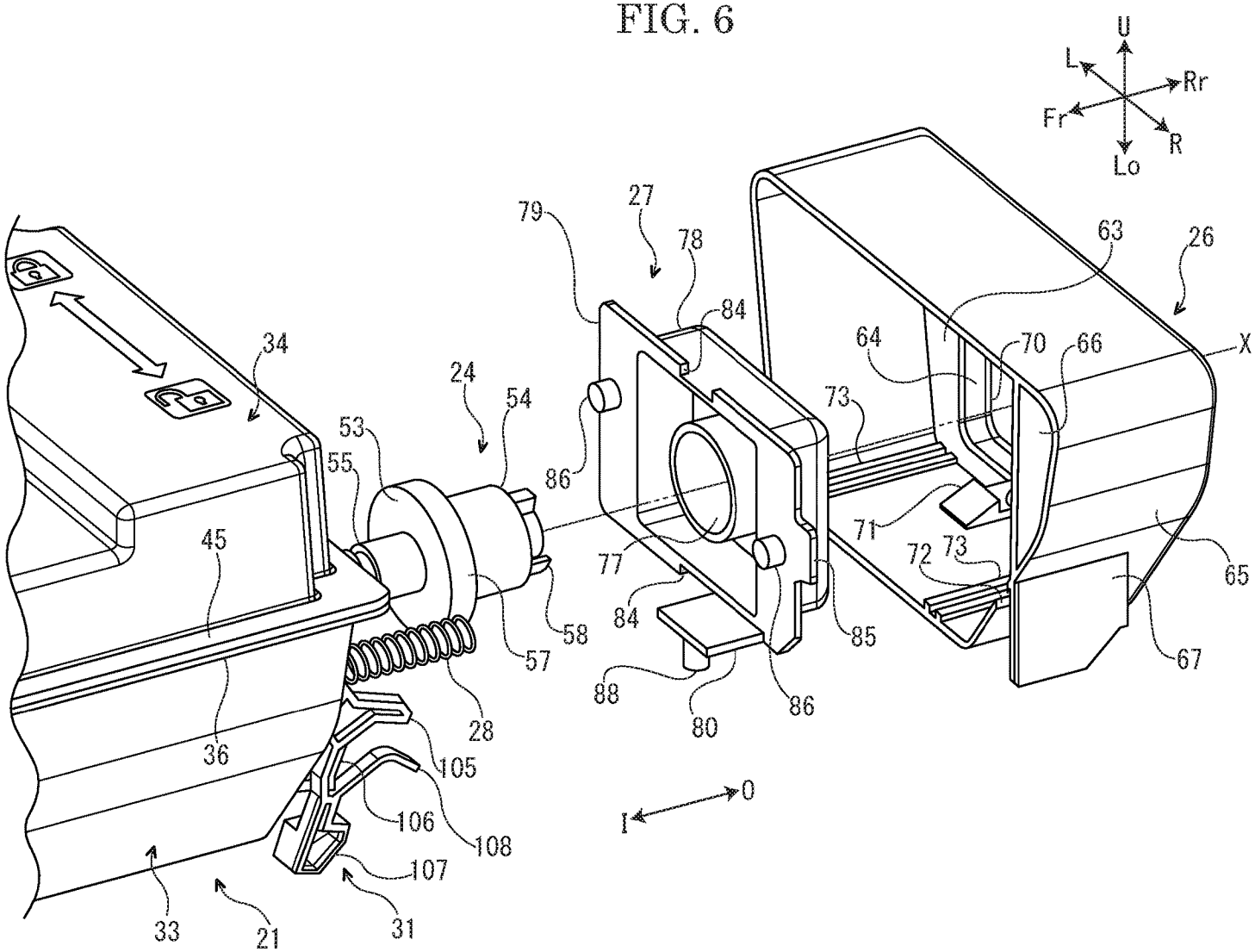
FIG. 6 is a disassembled perspective view showing the toner container according to the one embodiment of the present disclosure, when viewed from a right front side.

With reference to FIG. 5 and FIG. 6, the holder 26 of the toner container 15 is arranged at the rear side (the outside in the front-and-rear direction) of the case main body 21. That is, the holder 26 is arranged outside the case main body 21.

The holder 26 includes a base plate 63, an inner circumferential plate 64 protruding from an inner circumferential portion of the base plate 63 to the front side (the inside in the front-and-rear direction), an outer circumferential plate 65 protruding from an outer circumferential portion of the base plate 63 to the front side (the inside in the front-and-rear direction), a connecting plate 66 connecting an upper end portion and a right side portion of the outer circumferential plate 65, a lateral side covering plate 67 protruding from the right side portion of the outer circumferential plate 65 to the lower side and a rear side covering plate 68 protruding from the right side portion of the outer circumferential plate 65 to the lower side and arranged at a rear end side of the lateral side covering plate 67.

The base plate 63 of the holder 26 is formed in a plate-like shape. The base plate 63 is provided along a plane crossing the first rotation axis X. In a center portion of the base plate 63, a square hole part 70 is provided. Through the hole part 70, the transmitting coupling 58 of the transmitter is protruded to the rear side (the outside in the front-and-rear direction) further than the base plate 63.

Figure 7:
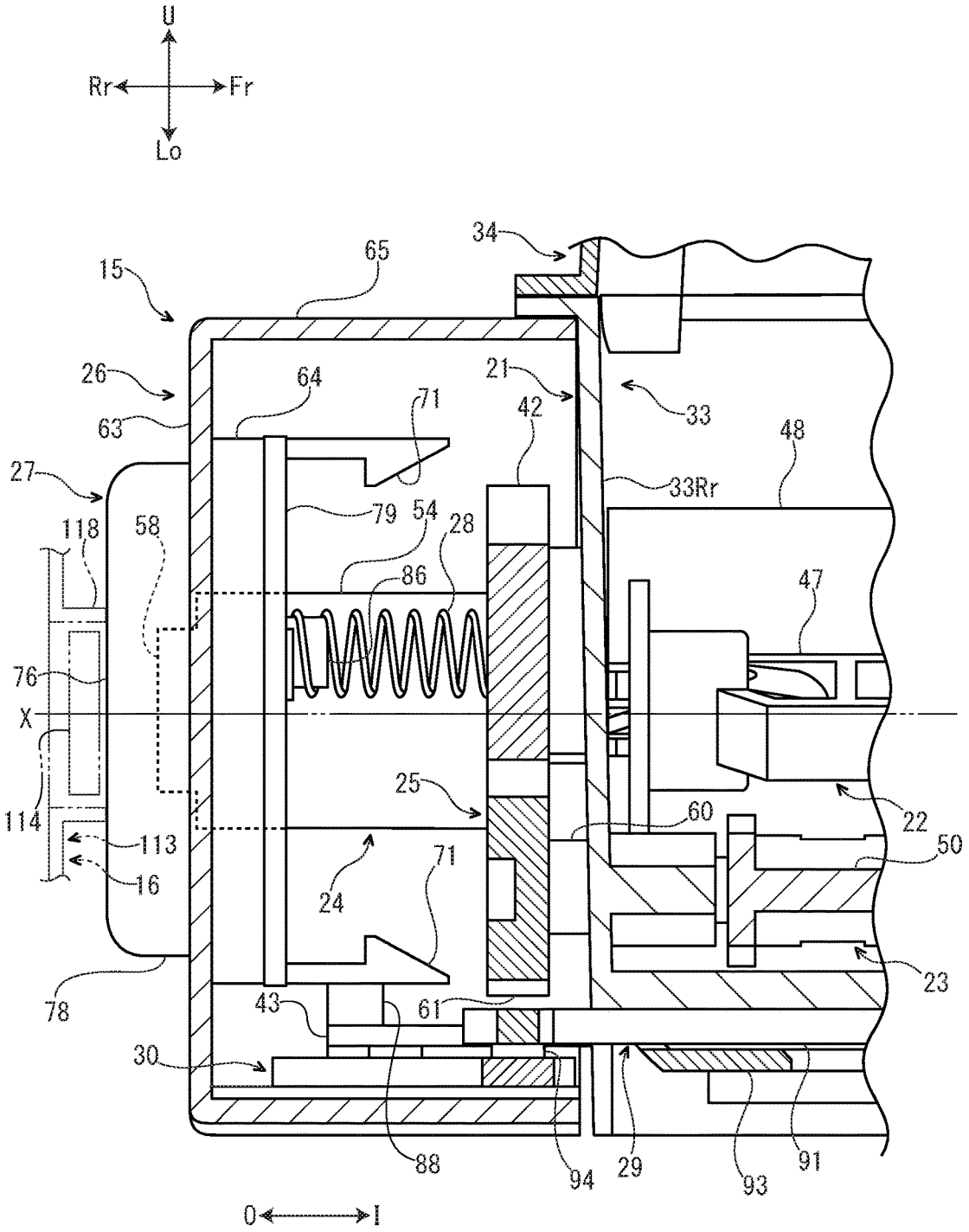
FIG. 7 is a sectional view showing the state where the cover is in the covering position and the shutter is in the closing position, when viewed from a left side, in the toner container according to the one embodiment of the present disclosure.
Figure 8:
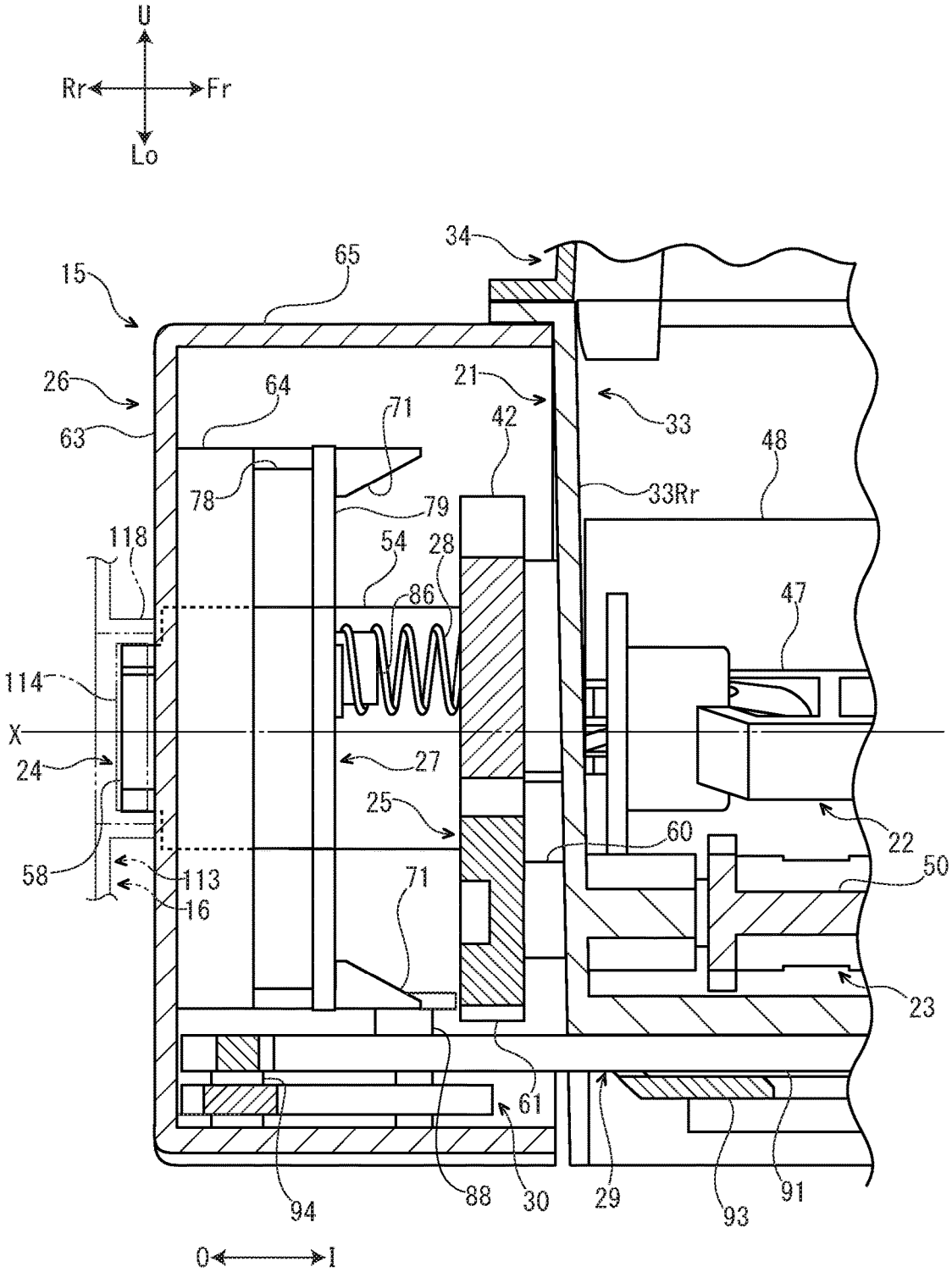
FIG. 8 is a sectional view showing the state where the cover is in the exposing position and the shutter is in the opening position, when viewed from the left side, in the toner container according to the one embodiment of the present disclosure.

The inner circumferential plate 64 of the holder 26 is formed in a square cylindrical shape. The inner circumferential plate 64 is protruded from the base plate 63 at an outer circumference of the hole part 70 to the front side (the inside in the front-and-rear direction). With reference to FIG. 7 and FIG. 8, on a tip end portion (an end portion at the inside in the front-and-rear direction) of the inner circumferential plate 64, a pair of upper and lower hook parts is protruded to the front side (the inside in the front-and-rear direction).

Figure 9:
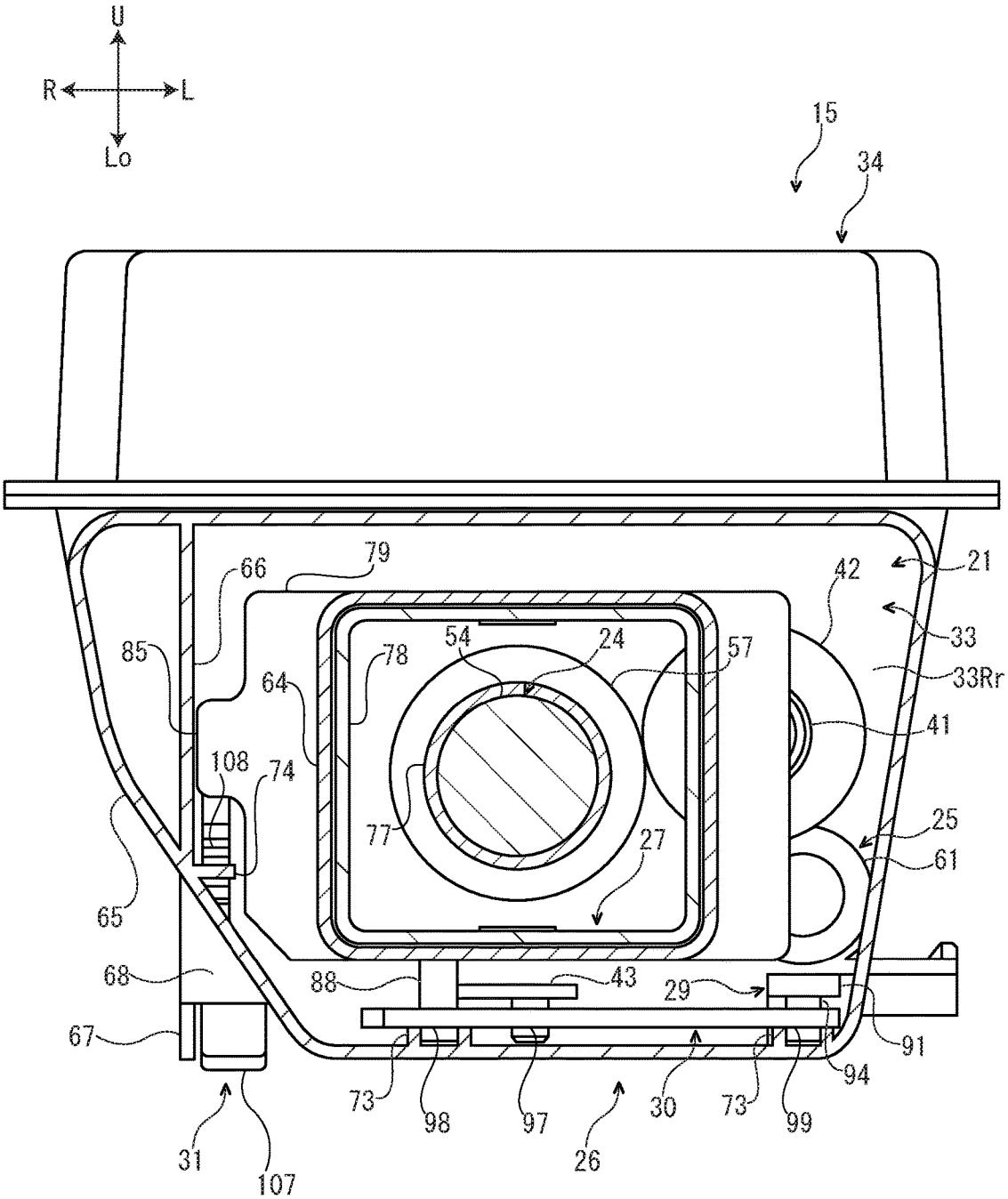
FIG. 9 is a sectional view showing the toner container according to the one embodiment of the present disclosure, when viewed from a rear side.

With reference to FIG. 5 and FIG. 6, the outer circumferential plate 65 of the holder 26 is formed in a cylindrical shape. In a right side portion of the outer circumferential plate 65, a notch 72 is provided. On an upper face (an inner face) of a lower end portion of the outer circumferential plate 65, a pair of left and right rail parts is protruded. Each rail part 73 extends along the front-and-rear direction. With reference to FIG. 9, on a left face (an inner face) of the right side portion of the outer circumferential plate 65, a contacting part 74 is protruded horizontally at the lower side of the connecting plate 66.

With reference to FIG. 5 and FIG. 6, the cover 27 of the toner container 15 includes a main wall 76, an inner circumferential wall 77 protruding from an inner circumferential portion of the main wall 76 to the front side (the inside in the front-and-rear direction), an outer circumferential wall 78 protruding from an outer circumferential portion of the main wall 76 to the front side (the inside in the front-and-rear direction), a guide wall 79 protruding from a front end portion (an end portion at the inside in the front-and-rear direction) of the outer circumferential wall 78 to an outside in a radial direction (a side separated from the first rotation axis X) and a protruding wall 80 protruding from a right lower portion of the front end portion of the outer circumferential wall 78 to the front side (the inside in the front-and-rear direction).

The main wall 76 of the cover 27 is formed in a plate-like shape. The main wall 76 is provided along a plane crossing the first rotation axis X. In a center portion of the main wall 76, a circular through hole 82 is provided. The main wall 76 has engaging holes 83 (an example of a first engaging part) at the left upper side and the right lower side of the through hole 82. The engaging holes 83 are provided at a different position for every type (for example, a destination, a color of the toner or a model of the multifunctional peripheral 1) of the toner container 15. That is, the toner container 15 having a type different from the toner container 15 of the present embodiment has the engaging holes 83 at a position different from the present embodiment (for example, at the right upper side and the left lower side of the through hole 82).

The inner circumferential wall 77 of the cover 27 is formed in a cylindrical shape. Into the inner circumferential wall 77, the transmitting piece 54 of the transmitter 24 is inserted. Thereby, the cover 27 rotatably holds the transmitter 24.

The outer circumferential wall 78 of the cover 27 is formed in a square cylindrical shape. The outer circumferential wall 78 is inserted into the inner circumferential plate 64 of the holder 26. Thereby, the cover 27 is held by the holder 26 so as to be movable along the front-and-rear direction.

The cover 27 is movable along the front-and-rear direction between a covering position (refer to FIG. 3, FIG. 7 and the others) where the inner circumferential wall 77 and the outer circumferential wall 78 cover an outer circumference of the transmitting coupling 58 of the transmitter 24 and an exposing position (refer to FIG. 4, FIG. 8 and the others) where the inner circumferential wall 77 and the outer circumferential wall 78 expose the transmitting coupling 58 of the transmitter 24. The exposing position is arranged at the front side (the inside in the front-and-rear direction) of the covering position.

With reference to FIG. 5 and FIG. 6, the guide wall 79 of the cover 27 has a pair of upper and lower guide grooves 84. With each guide groove 84, each hook part 71 of the holder 26 is engaged. On a right side portion of the guide wall 79, a guide piece 85 is protruded to the right side. On a front face (a face at the inside in the front-and-rear direction) of the guide wall 79, a pair of left and right guide projections 86 is protruded.

On a lower face of the protruding wall 80 of the cover 27, a first engaging piece 88 is protruded. The first engaging piece 88 is arranged at the front side (the inside in the front-and-rear direction) of the inner circumferential wall 77 and the outer circumferential wall 78 of the cover 27. With reference to FIG. 9, a lower end portion of the first engaging piece 88 is engaged with the right rail part 73 provided in the outer circumferential plate 65 of the holder 26.

With reference to FIG. 5 and FIG. 6, the pair of left and right coil springs 28 of the toner container 15 is interposed between the rear side wall 33Rr of the storage 33 of the case main body 21 and the guide wall 79 of the cover 27. A rear end portion of each coil spring 28 is engaged with each guide projection 86 of the guide wall 79. Each coil spring 28 presses the cover 27 to the rear side (the outside in the front-and-rear direction) to bias the cover 27 to the covering position (refer to FIG. 3, FIG. 7 and the others).

Figure 10:
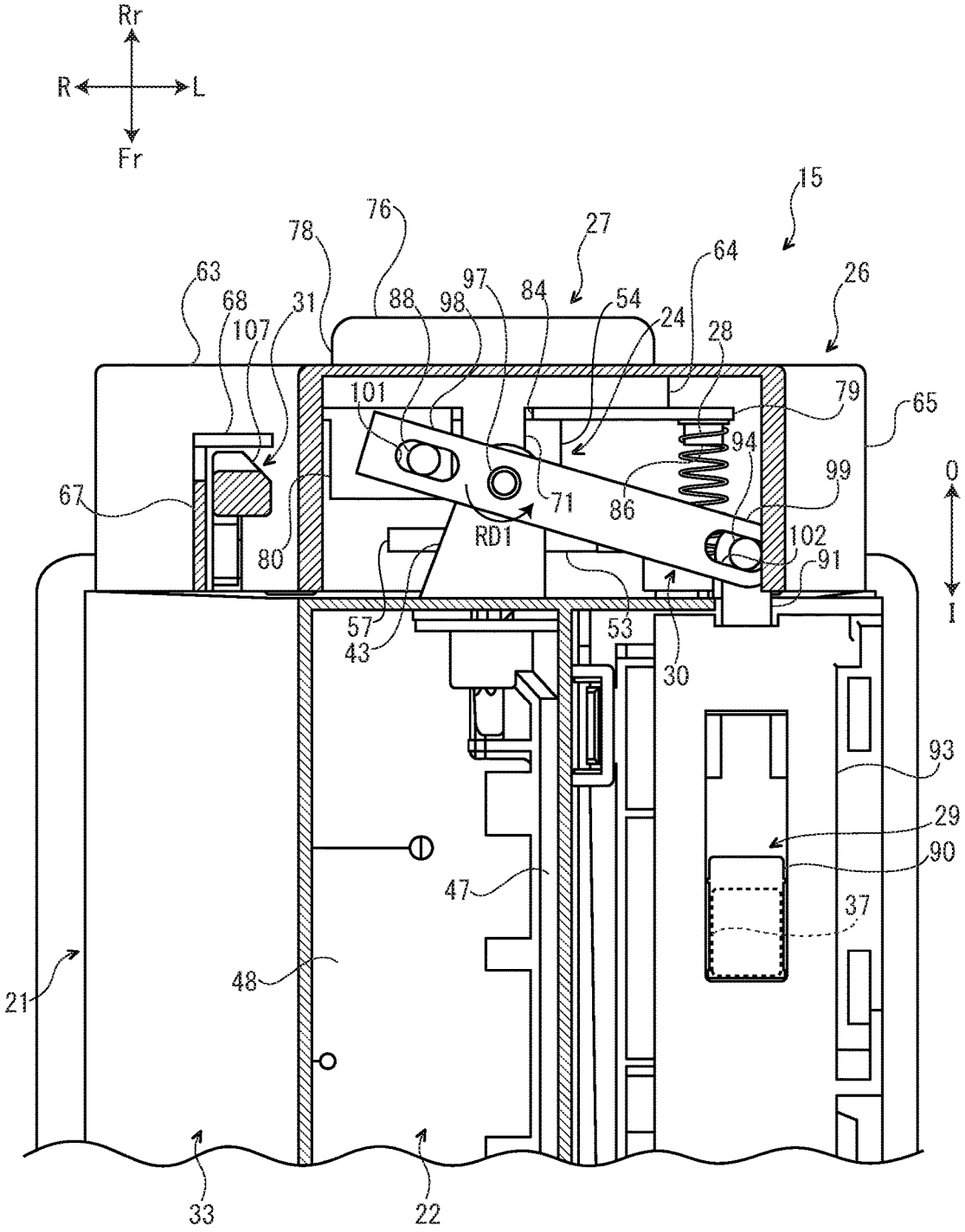
FIG. 10 is a sectional view showing the state where the cover is in the covering position and the shutter is in the closing position, when viewed from a lower side, in the toner container according to the one embodiment of the present disclosure.
Figure 11:
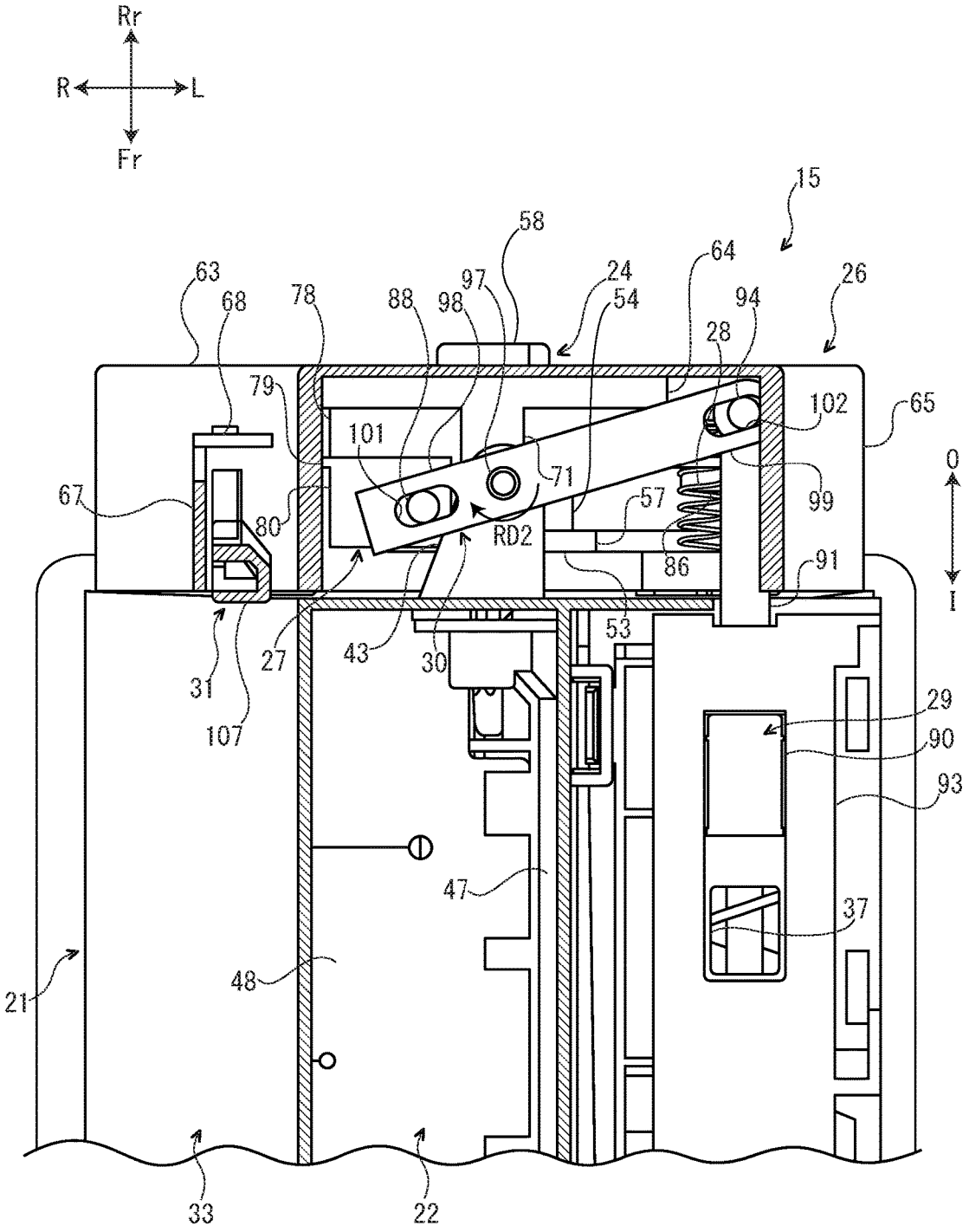
FIG. 11 is a sectional view showing the state where the cover is in the exposing position and the shutter is in the opening position, when viewed from the lower side, in the toner container according to the one embodiment of the present disclosure.

With reference to FIG. 10 and FIG. 11, the shutter 29 of the toner container 15 includes a main plate 90 and an engaging plate 91 extending from a rear end portion of the main plate 90 to the rear side (the outside in the front-and-rear direction).

The main plate 90 of the shutter 29 has a shape elongated in the front-and-rear direction. The main plate 90 is arranged along a lower face (an outer face) of the storage 33 of the case main body 21. The main plate 90 is supported by a supporting body 93 fixed to the lower face of the storage 33 of the case main body 21, from the lower side (the outer face side).

The shutter 29 is movable along the front-and-rear direction between a closing position (refer to FIG. 10 and the others) where the main plate 90 closes the toner discharge port 37 provided in the storage 33 of the case main body 21 and an opening position (refer to FIG. 11 and the others) where the main plate 90 opens the toner discharge port 37. The opening position is arranged at the rear side (the outside in the front-and-rear direction) of the closing position.

The engaging plate 91 of the shutter 29 has a shape elongated in the front-and-rear direction. A rear end portion of the engaging plate 91 is always arranged at the rear side (the outside in the front-and-rear direction) of the storage 33 of the case main body 21. On a lower face of the rear end portion of the engaging plate 91, a second engaging piece 94 is protruded. The second engaging piece 94 is arranged at the rear side (the outside in the front-and-rear direction) of the main plate 90 of the shutter 29. With reference to FIG. 9, a lower end portion of the second engaging piece 94 is engaged with the left rail part 73 provided on the outer circumferential plate 65 of the holder 26.

With reference to FIG. 10 and FIG. 11, the link 30 of the toner container 15 is arranged at the rear side (the outside in the front-and-rear direction) of the case main body 21. That is, the link 30 is arranged outside the case main body 21. The link 30 is supported by the supporting plate 43 of the case main body 21. The link 30 is rotatable around a fulcrum 97.

The link 30 includes a first arm part 98 extending from the fulcrum 97 to the right side (one side) and a second arm part 99 extending from the fulcrum 97 to the left side (the other side). The first arm part 98 and the second arm part 99 are arranged on the same line. The first arm part 98 has a first long hole 101 with which the first engaging piece 88 of the cover 27 is engaged. The second arm part 99 has a second long hole 102 with which the second engaging piece 94 of the shutter 29 is engaged. According to the above described configuration, the cover 27 and the shutter 29 are connected by the link 30. A distance between the fulcrum 97 and the first long hole 101 is shorter than a distance between the fulcrum 97 and the second long hole 102.

Figure 12:
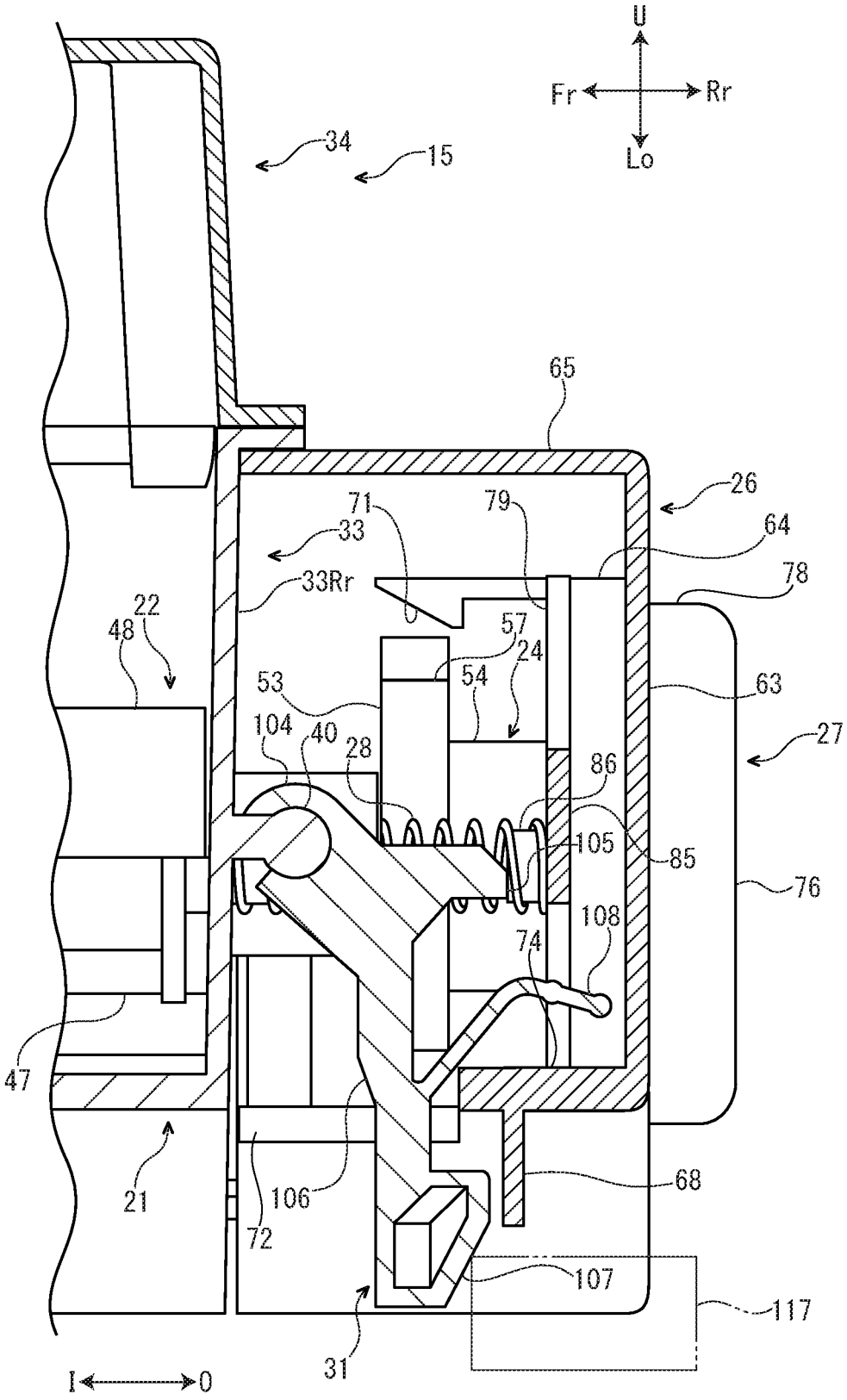
FIG. 12 is a sectional view showing a state where a restriction member is in a restricting position, in the toner container according to the one embodiment of the present disclosure.
Figure 13:
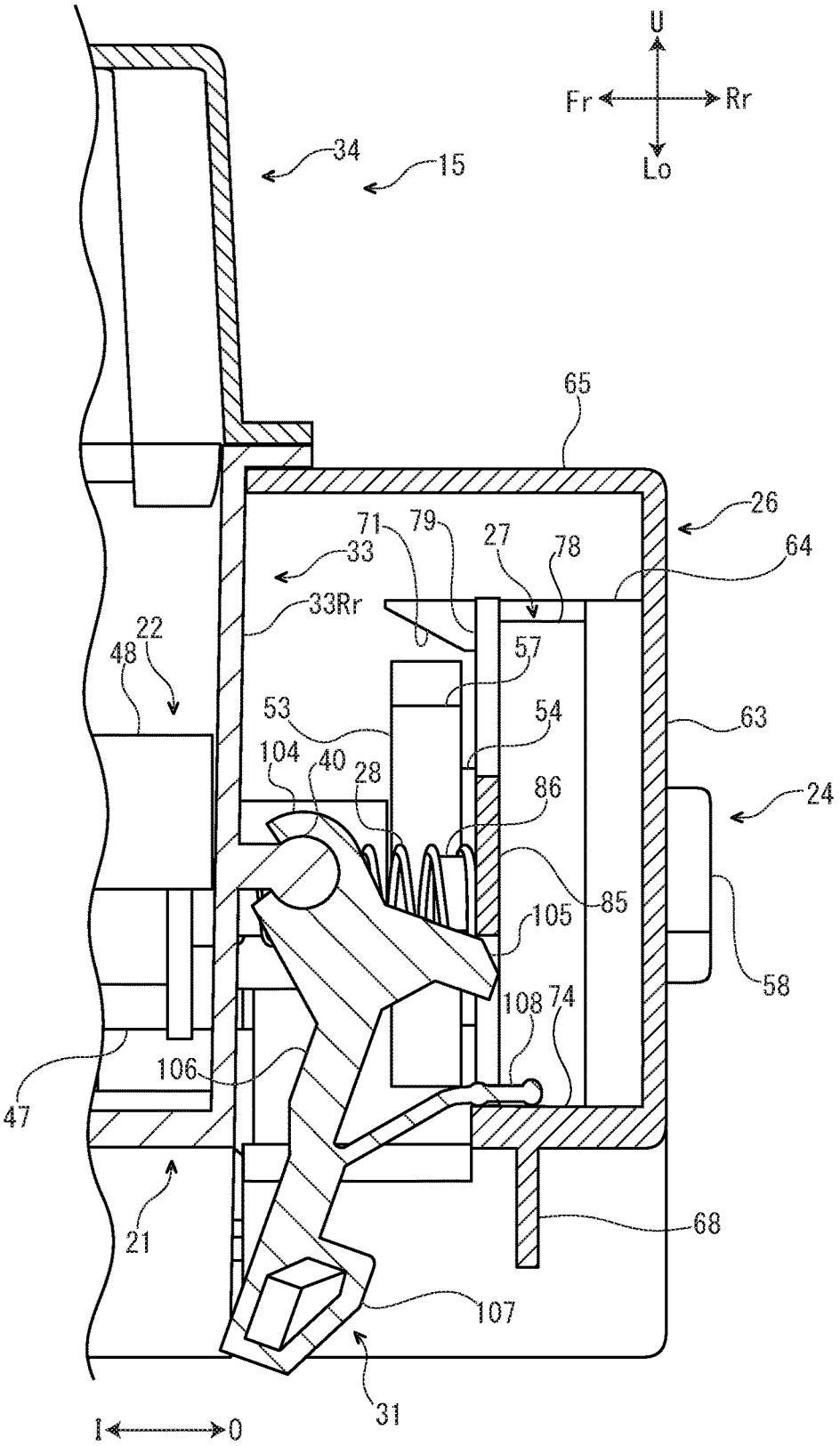
FIG. 13 is a sectional view showing a state where the restriction member is in a restriction releasing position, in the toner container according to the one embodiment of the present disclosure.

With reference to FIG. 12 and FIG. 13, the restriction member 31 of the toner container 15 includes a mounting part 104, a restriction part 105 extending from the mounting part 104 to the rear side (the outside in the front-and-rear direction), an arm part 106 extending from a portion between the mounting part 104 and the restriction part 105 to the lower side, a pressed part 107 protruding from a lower end portion of the arm part 106 to the rear side (the outside in the front-and-rear direction) and an elastic part 108 protruding from a center portion in the upper-and-lower direction of the arm part 106 to the rear side (the outside in the front-and-rear direction).

The mounting part 104 of the restriction member 31 is mounted to the mounting projection 40 of the case main body 21. Thereby, the restriction member 31 is supported by the case main body 21 so as to be rotatable around the mounting part 104 between a restricting position (refer to FIG. 12) and a restriction releasing position (refer to FIG. 13).

The restriction part 105 of the restriction member 31 is arranged at the front side (the inside in the front-and-rear direction) of the guide piece 85 of the cover 27 in a state where the restriction member 31 is in the restricting position. Thereby, moving of the cover 27 from the covering position to the exposing position is restricted. The restriction part 105 separates from the front side (the inside in the front-and-rear direction) of the guide piece 85 of the cover 27 in a state where the restriction member 31 is in the restriction releasing position. Thereby, the moving of the cover 27 from the covering position to the exposing position is permitted.

The arm part 106 of the restriction member 31 is engaged with the notch 72 of the holder 26. The elastic part 108 of the restriction member 31 is elastically deformable. A rear side (the outside in the front-and-rear direction) of the restriction member 31 except the pressed part 107 is covered with the base plate 63 and the rear side covering plate 68 of the holder 26. With reference to FIG. 9, a right side of the restriction member 31 is covered with the connecting plate 66 and the lateral side covering plate 67 of the holder 26.

Next, the four attachment parts 16 will be described in detail. The four attachment parts 16 have the same configuration, and, therefore, one of the four attachment parts 16 will be described and other attachment parts 16 will not be described.

Figure 14:
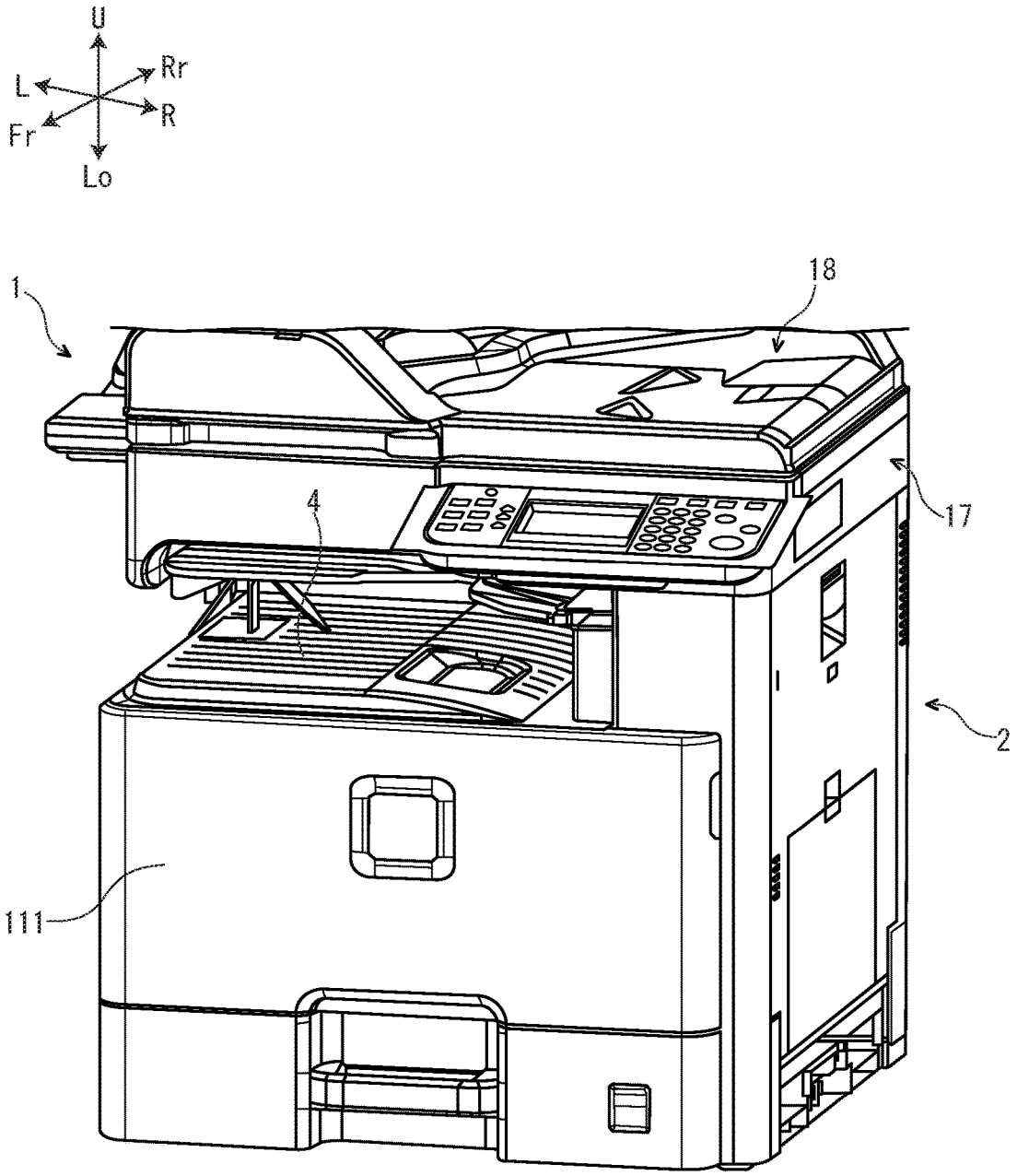
FIG. 14 is a perspective view showing a state where a front cover is closed, in the multifunctional peripheral according to the one embodiment of the present disclosure.
Figure 15:
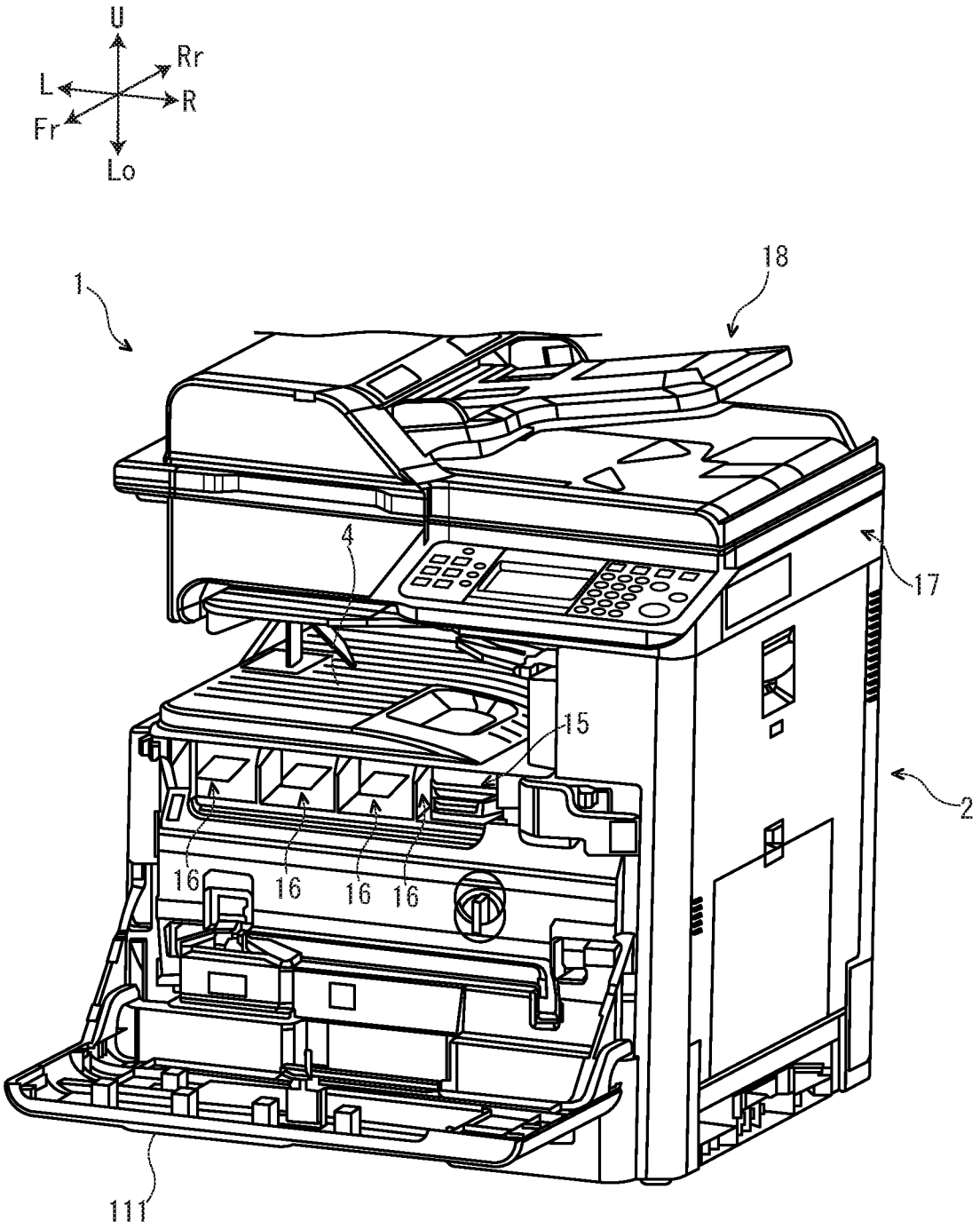
FIG. 15 is a perspective view showing a state where the front cover is opened, in the multifunctional peripheral according to the one embodiment of the present disclosure.

With reference to FIG. 14 and FIG. 15, a front side of the attachment part 16 is covered with an openable and closable front cover 111. By opening the front cover 111, it becomes possible to attach and detach the toner container 15 to and from the attachment part 16. The attachment part 16 constitutes a part of the multifunctional peripheral main body 2.

Figure 16:
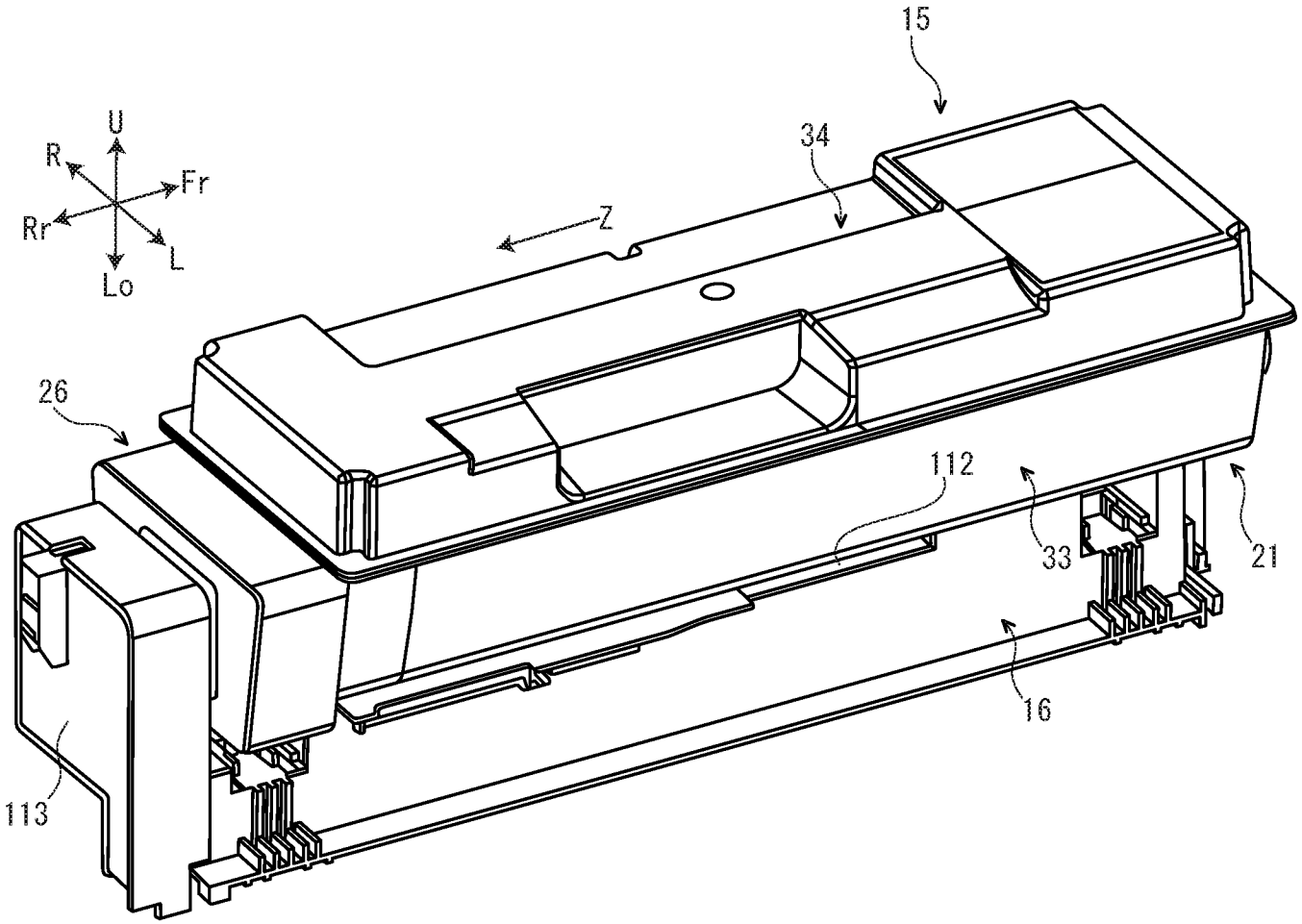
FIG. 16 is a perspective view showing a state where the toner container is attached to an attachment part, in the multifunctional peripheral according to the one embodiment of the present disclosure.

With reference to FIG. 16, to the attachment part 16, the toner container 15 is detachably attached along an attachment direction Z from the front side to the rear side. The attachment direction Z is parallel to the front-and-rear direction.

Figure 17:
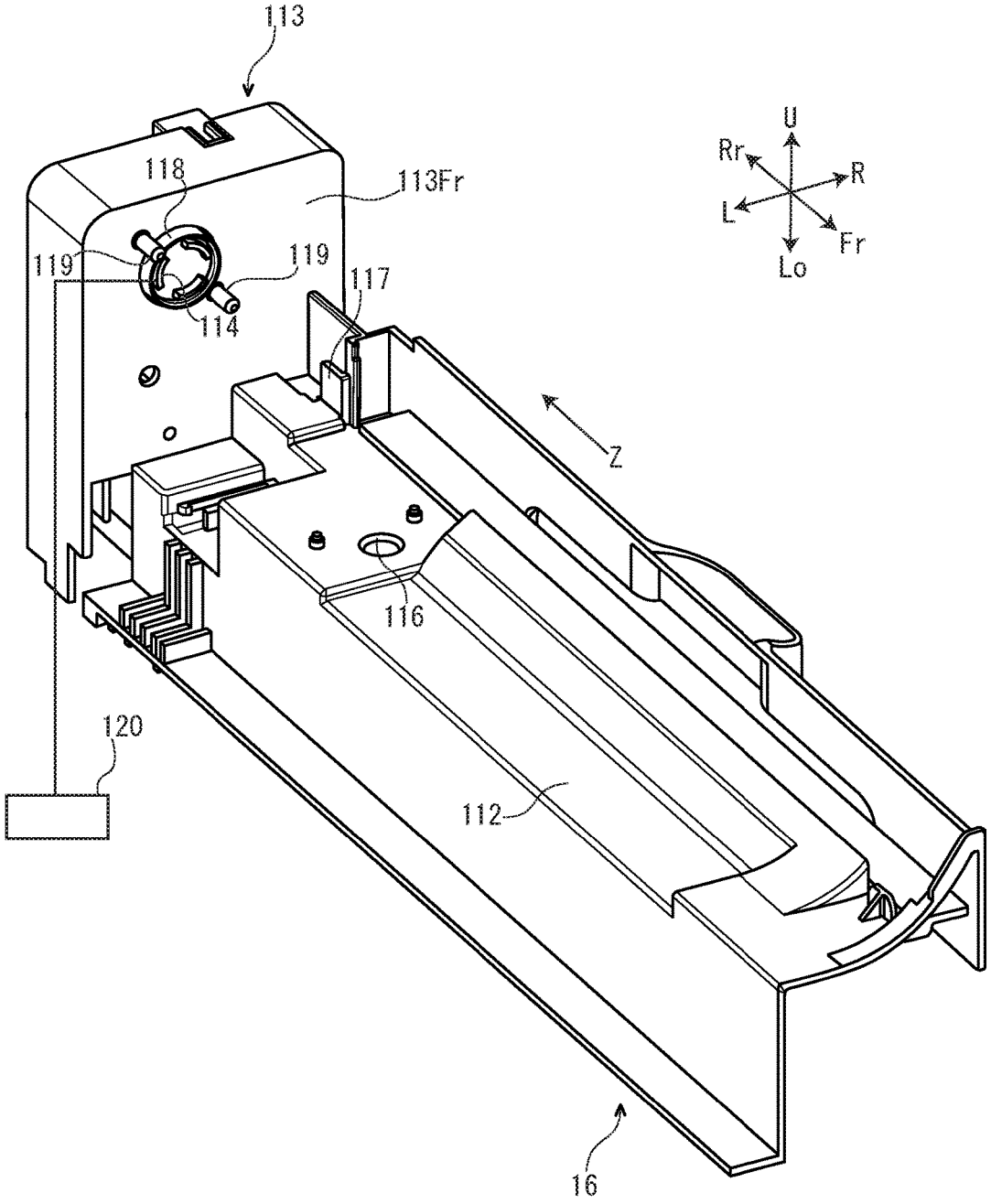
FIG. 17 is a perspective view showing the attachment part and a driving source according to the one embodiment of the present disclosure.

With reference to FIG. 17, the attachment part 16 includes a guide plate 112, a casing 113 arranged at the rear side of the guide plate 112 and a driving coupling 114 stored in an upper portion of the casing 113.

The guide plate 112 of the attachment part 16 extends along the front-and-rear direction. In a rear portion of the guide plate 112, a replenishment port 116 is provided. On a rear portion of an upper face (an outer face) of the guide plate 112, a pressing part 117 is protruded at the rear side (a downstream side in the attachment direction Z) of the replenishment port 116 and at the front side (an upstream side in the attachment direction Z) of the casing 113.

On a front wall 113Fr of the casing 113 of the attachment part 16, a cylindrical piece 118 is protruded to the front side. On the front wall 113Fr of the casing 113, engaging projections 119 (an example of a second engaging part) are protruded at the left upper side and the right lower side of the cylindrical piece 118. The engaging projections 119 are provided at a different position for every type (for example, a destination, a color of the toner or a model of the multifunctional peripheral 1) of the attachment part 16. That is, the attachment part 16 having a type different from the attachment part 16 of the present embodiment includes the engaging projections 119 at a position different from the present embodiment (for example, at the right upper side and the left lower side of the cylindrical piece 118).

The driving coupling 114 of the attachment part 16 is arranged in an inner circumference of the cylindrical piece 118 of the casing 113. The driving coupling 114 is connected to a driving source 120 constituted by a motor and the others.

Next, an operation to discharge the toner from the toner container 15 will be described.

With reference to FIG. 2, when the toner is discharged from the toner container 15, in a state where the transmitting coupling 58 of the transmitter 24 is coupled to the driving coupling 114 and the toner discharge port 37 is opened, the driving source 120 is driven. When the driving source 120 is driven, the driving coupling 114 is rotated by rotation driving force from the driving source 120. When the driving coupling 114 is thus rotated, rotation of the driving coupling 114 is transmitted to the agitator 22 by the transmitter 24, and the agitator 22 is rotated. As a result, the toner stored in the storage 33 of the case main body 21 is agitated by the agitator 22.

When the driving coupling 114 is rotated as described above, the rotation is transmitted to the conveyer 23 by the transmitter 24, the idle gear 42 and the connector 25, and the conveyer 23 is rotated. As a result, as shown by an arrow A in FIG. 2, the toner stored in the storage 33 of the case main body 21 is conveyed toward the discharge port 37 by the conveyer 23. The toner thus conveyed toward the discharge port 37 is discharged through the discharge port 37 to the outside of the toner container 15. The toner discharged to the outside of the toner container 15 is replenished to the developing device (refer to FIG. 1) of the image forming part 6 through a replenishment port 116 (refer to FIG. 17) of the attachment part 16.

Next, an example of a work to check an operation of the cover 27 and the shutter 29 by a worker, such as a user and a serviceman, will be described.

In a state where the toner container 15 is detached from the attachment part 16, the restriction member 31 is arranged in the restricting position (refer to FIG. 12) and the restriction part 105 of the restriction member 31 is arranged at the front side (the inside in the front-and-rear direction) of the guide piece 85 of the cover 27. Thereby, the moving of the cover 27 from the covering position (refer to FIG. 3, FIG. 7 and the others) to the exposing position (refer to FIG. 4, FIG. 8 and the others) is restricted, and the cover 27 is held in the covering position. As a result, the outer circumference of the transmitting coupling 58 of the transmitter 24 is covered with the inner circumferential wall 77 and the outer circumferential wall 78 of the cover 27. In the state where the toner container 15 is detached from the attachment part 16, the shutter 29 is arranged in the closing position (refer to FIG. 10 and the others).

Firstly, the worker presses the pressed part 107 of the restriction member 31 toward the front side. The pressing rotates the restriction member 31 from the restricting position (refer to FIG. 12) to the restriction releasing position (refer to FIG. 13). Consequently, the elastic part 108 of the restriction member 31 comes into contact with the contacting part 74 of the holder 26 to be elastically deformed, and the restriction member 31 is biased to the restricting position by elastic returning force of the elastic part 108.

Next, the worker presses the cover 27 toward the front side (the inside in the front-and-rear direction). Consequently, the cover 27 moves toward the front side (the inside in the front-and-rear direction) from the covering position (refer to FIG. 3, FIG. 7 and the others) to the exposing position (refer to FIG. 4, FIG. 8 and the others) against biasing force of the pair of left and right coil springs 28, and the transmitting coupling 58 of the transmitter 24 is exposed.

With reference to FIG. 10, as the cover 27 moves from the covering position to the exposing position as described above, the first engaging piece 88 of the cover 27 presses the first arm part 98 of the link 30 toward the front side (the inside in the front-and-rear direction). The pressing rotates the link 30 in a predetermined direction around the fulcrum 97, as shown by an arrow RD1 in FIG. 10. Consequently, the second arm part 99 of the link 30 presses the second engaging piece 94 of the shutter 29 toward the rear side (the outside in the front-and-rear direction), and the shutter 29 moves toward the rear side from the closing position (refer to FIG. 10 and the others) to the opening position (refer to FIG. 11 and the others). That is, the shutter 29 moves in a direction opposing to the cover 27.

Next, the worker releases the pressing of the cover 27. Consequently, the cover 27 moves toward the rear side (the outside in the front-and-rear direction) from the exposing position (refer to FIG. 4, FIG. 8 and the others) to the covering position (refer to FIG. 3, FIG. 7 and the others) by the biasing force of the pair of left and right coil springs 28. As a result, the outer circumference of the transmitting coupling 58 of the transmitter 24 is covered with the inner circumferential wall 77 and the outer circumferential wall 78 of the cover 27.

With reference to FIG. 11, as the cover 27 moves from the exposing position to the covering position as described above, the first engaging piece 88 of the cover 27 presses the first arm part 98 of the link 30 toward the rear side (the outside in the front-and-rear direction). The pressing rotates the link 30 in a direction opposing to the above predetermined direction around the fulcrum 97, as shown by an arrow RD2 in FIG. 11. Consequently, the second arm part 99 of the link 30 presses the second engaging piece 94 of the shutter 29 toward the front side (the inside in the front-and-rear direction), and the shutter 29 moves toward the front side from the opening position (refer to FIG. 11 and the others) to the closing position (refer to FIG. 10 and the others). That is, the shutter 29 moves in a direction opposing to the cover 27.

Next, the worker releases the pressing of the pressed part 107 of the restriction member 31. Consequently, the restriction member 31 rotates from the restriction releasing position (refer to FIG. 13) to the restricting position (refer to FIG. 12) by elastic returning force of the elastic part 108.

As described above, in the present embodiment, the toner container 15 includes the cover 27 which moves along the front-and-rear direction between the covering position where the cover 27 covers the outer circumference of the transmitting coupling 58 of the transmitter 24 and the exposing position where the cover 27 exposes the transmitting coupling 58. Accordingly, it becomes possible to switch between a state where the transmitting coupling 58 is covered and another state where the transmitting coupling 58 is exposed, by using a simple structure.

Additionally, as the cover 27 moves from the covering position to the exposing position, the shutter 29 moves from the closing position to the opening position, and as the cover 27 moves from the exposing position to the covering position, the shutter 29 moves from the opening position to the closing position. By linking the moving of the cover 27 with the moving of the shutter 29, the operation to move the cover 27 makes it possible to perform the both works to check the operation of the cover 27 and to check the operation of the shutter 29. That is, the one operation makes it possible to perform the two works. Accordingly, it becomes possible to suppress increasing of a number of steps of the check operation for the toner container 15 and to improve workability of the check operation for the toner container 15.

As described above, when the operation of the cover 27 and the shutter 29 is checked, the shutter 29 moves between the opening position and the closing position. Thereby, if the operation of the cover 27 and the shutter 29 is checked in a state where the discharge port 37 faces downward, when the shutter 29 moves to the opening position, the toner may be dropped through the discharge port 37. Accordingly, when the operation of the cover 27 and the shutter 29 is checked, the toner container 15 is preferably reversed in the upper-and-lower direction to face the discharge port 37 upward.

Additionally, the link 30 includes the first arm part 98 which extends from the fulcrum 97 to the right side (the one side) and is engaged with the first engaging piece 88 of the cover 27 and the second arm part 99 which extends from the fulcrum 97 to the left side (the other side) and is engaged with the second engaging piece 94 of the shutter 29. By applying such a configuration, it becomes possible to move the shutter 29 in a direction opposing to the cover 27.

Additionally, the first engaging piece 88 of the cover 27 is arranged at the front side (the inside in the front-and-rear direction) of the inner circumferential wall 77 and the outer circumferential wall 78 of the cover 27, and the second engaging piece 94 of the shutter 29 is arranged at the rear side (the outside in the front-and-rear direction) of the main plate 90 of the shutter 29. By applying such a configuration, if the inner circumferential wall 77 and the outer circumferential wall 78 of the cover 27 are separated from the main plate 90 of the shutter 29 in the front-and-rear direction, it becomes possible to connect the cover 27 and the shutter 29 by the link 30.

Additionally, the toner container 15 includes the restriction member 31 which rotates between the restricting position where the restriction member 31 restricts the moving of the cover 27 from the covering position to the exposing position and the restriction releasing position where the restriction member 31 permits the moving of the cover 27 from the covering position to the exposing position. Accordingly, it becomes possible to inhibit the accidental moving of the cover 27 from the covering position to the exposing position and to inhibit the transmitting coupling 58 of the transmitter 24 from being damaged.

Additionally, the restriction member 31 except the pressed part 107 is covered with the holder 26. Accordingly, it becomes possible to inhibit the restriction member 31 from being manipulated by the worker incorrectly and to inhibit the accidental moving of the cover 27 from the covering position to the exposing position more effectively.

Additionally, when the restriction member 31 rotates from the restricting position to the restriction releasing position, the elastic part 108 of the restriction member 31 comes into contact with the contacting part 74 of the holder 26 to be elastically deformed, and the restriction member 31 is biased to the restricting position by the elastic returning force of the elastic part 108. By applying such a configuration, it becomes possible to return the restriction member 31 to the restricting position surely by a simple structure.

Additionally, the toner container 15 includes the pair of left and right coil springs 28 biasing the cover 27 to the covering position. By applying such a configuration, it becomes possible to inhibit the toner container 15 from being left in a state where the cover 27 is arranged in the exposing position and to inhibit the transmitting coupling 58 of the transmitter 24 from being damaged more effectively.

Additionally, the multifunctional peripheral 1 includes the toner container 15 and the attachment part 16 to which the toner container 15 is detachably attached. By applying such a configuration, it becomes possible to replace the toner container 15 easily.

Next, a work to attach and detach the toner container 15 to and from the attachment part 16 by a worker, such as a user and a serviceman, will be described. The same work as the work to check the operation of the cover 27 and the shutter 29 is not described.

When the worker attaches the toner container 15 to the attachment part 16, the worker inserts the toner container 15 to the attachment part 16 along the attachment direction Z. When the toner container 15 is inserted to a predetermined position in the attachment part 16, as shown by a two-dot chain line in FIG. 12, the pressing part 117 of the attachment part 16 comes into contact with the pressed part 107 of the restriction member 31, and presses the pressed part 107 toward the front side. Consequently, the restriction member 31 rotates from the restricting position (refer to FIG. 12) to the restriction releasing position (refer to FIG. 13).

When the worker further inserts the toner container 15 to the attachment part 16 along the attachment direction Z, as shown by a two-dot chain line in FIG. 7, the main wall 76 of the cover 27 comes into contact with the cylindrical piece 118 of the casing 113. Thereby, the moving of the cover 27 to the rear side (the downstream side in the attachment direction Z) is restricted.

When the worker further inserts the toner container 15 to the attachment part 16 along the attachment direction Z, as shown by a two-dot chain line in FIG. 8, the toner container 15 is attached to the attachment part 16. Consequently, the case main body 21 moves toward the rear side (the downstream side in the attachment direction Z) with respect to the cover 27 from a position where the cover 27 is arranged in the covering position (refer to FIG. 3, FIG. 7 and the others) to another position where the cover 27 is arranged in the exposing position (refer to FIG. 4, FIG. 8 and the others). As a result, the transmitting coupling 58 of the transmitter 24 is exposed, and coupled to the driving coupling 114.

With reference to FIG. 10, as the case main body 21 moves with respect to the cover 27 from the position where the cover 27 is arranged in the covering position to the other position where the cover 27 is arranged in the exposing position as described above, the first engaging piece 88 of the cover 27 presses the first arm part 98 of the link 30 toward the front side (the inside in the front-and-rear direction). The pressing rotates the link 30 in the predetermined direction around the fulcrum 97, as shown by the arrow RD1 in FIG. 10. Consequently, the second arm part 99 of the link 30 presses the second engaging piece 94 of the shutter 29 toward the rear side (the outside in the front-and-rear direction), and the shutter 29 moves toward the rear side from the closing position (refer to FIG. 10 and the others) to the opening position (refer to FIG. 11 and the others).

When the type of the toner container 15 matches the type of the attachment part 16, each engaging hole 83 of the cover 27 is engaged with each engaging projection 119 of the casing 113, and the attaching of the toner container 15 to the attachment part 16 is permitted. Thereby, the coupling of the transmitting coupling 58 of the transmitter 24 to the driving coupling 114 is permitted as described above. On the other hand, if the type of the toner container 15 does not match the type of the attachment part 16, each engaging hole 83 of the cover 27 is not engaged with each engaging projection 119 of the casing 113, each engaging projection 119 interferes with the main wall 76 of the cover 27, and the attaching of the toner container 15 to the attachment part 16 is inhibited. Thereby, the coupling of the transmitting coupling 58 of the transmitter 24 to the driving coupling 114 is inhibited. By applying such a configuration, it becomes possible to inhibit an incompatible toner container 15 from being incorrectly attached to the attachment part 16.

On the other hand, when the toner container 15 is detached from the attachment part 16, the worker pulls out the toner container 15 from the attachment part 16 in a direction opposing to the attachment direction Z. As a result, the coupling of the transmitting coupling 58 of the transmitter 24 to the driving coupling 114 is released.

Additionally, when the toner container 15 is pulled out from the attachment part 16 as described above, the case main body 21 moves toward the front side (the upstream side in the attachment direction Z) with respect to the cover 27 from the position where the cover 27 is arranged in the exposing position (refer to FIG. 4, FIG. 8 and the others) to the other position where the cover 27 is arranged in the covering position (refer to FIG. 3, FIG. 7 and the others). As a result, the outer circumference of the transmitting coupling 58 of the transmitter 24 is covered with the inner circumferential wall 77 and the outer circumferential wall 78 of the cover 27.

With reference to FIG. 11, as the case main body 21 moves with respect to the cover 27 from the position where the cover 27 is arranged in the exposing position to the other position where the cover 27 is arranged in the covering position as described above, the first engaging piece 88 of the cover 27 presses the first arm part 98 of the link 30 toward the rear side (the outside in the front-and-rear direction). The pressing rotates the link 30 in the direction opposing to the above predetermined direction around the fulcrum 97, as shown by the arrow RD2 in FIG. 11. Consequently, the second arm 99 of the link 30 presses the second engaging piece 94 of the shutter 29 toward the front side (the inside in the front-and-rear direction), and the shutter 29 moves toward the front side from the opening position (refer to FIG. 11 and the others) to the closing position (refer to FIG. 10 and the others).

As described above, in the present embodiment, as the toner container 15 is attached to the attachment part 16, the main wall 76 of the cover 27 comes into contact with the cylindrical piece 118 of the casing 113, and the moving of the cover 27 to the rear side (the downstream side in the attachment direction Z) is restricted. Then, the case main body 21 moves toward the rear side (the downstream side in the attachment direction Z) with respect to the cover 27 from the position where the cover 27 is arranged in the covering position to the other position where the cover 27 is arranged in the exposing position, and the transmitting coupling 58 of the transmitter 24 is coupled to the driving coupling 114. By applying such a configuration, when the toner container 15 is attached to the attachment part 16, the transmitting coupling 58 of the transmitter 24 is automatically exposed, and coupled to the driving coupling 114. Thereby, it becomes possible to reduce a worker's load for the attachment and detachment work of the toner container 15.

Additionally, as the toner container 15 is attached to the attachment part 16, the pressing part 117 provided in the attachment part 16 presses the pressed part 107 of the restriction member 31, and the restriction member 31 rotates from the restricting position to the restriction releasing position. By applying such a configuration, when the toner container 15 is attached to the attachment part 16, the restriction member 31 automatically rotates from the restricting position to the restriction releasing position. Thereby, it becomes possible to reduce the worker's load for the attachment and detachment work of the toner container 15 more effectively.

In the present embodiment, the first engaging part is the engaging hole 83 and the second engaging part is the engaging projection 119. On the other hand, in another embodiment, the first engaging part may be the engaging projection and the second engaging part may be the engaging hole.

In the present embodiment, the main plate 90 of the shutter 29 is arranged along the lower face (the outer face) of the storage 33 of the case main body 21. On the other hand, in another embodiment, the main plate 90 of the shutter 29 may be arranged along an upper face (the inner face) of the storage 33 of the case main body 21.

In the present embodiment, entire parts of the agitator 22 and the conveyer 23 are stored in the case main body 21. On the other hand, in another embodiment, parts of the agitator 22 and/or the conveyer 23 may by stored in the case main body 21.

In the present embodiment, a part of the transmitter 24 is arranged outside the case main body 21. On the other hand, in another embodiment, an entire part of the transmitter 24 may be arranged outside the case main body 21.

In the present embodiment, the configuration of the present disclosure is applied to the multifunctional peripheral 1 (an image forming apparatus including multiple functions, such as printing function, copying function and facsimile function). On the other hand, in still another embodiment, the configuration of the present disclosure may be applied to an image forming apparatus, such as a printer, a copying machine and a facsimile, other than the multifunctional peripheral 1.

While the present disclosure has been described with reference to the particular illustrative embodiments, it is not to be restricted by the embodiments. It is to be appreciated that those skilled in the art can change or modify the embodiments without departing from the scope and spirit of the present disclosure.

The invention claimed is:

1. A toner case comprising:

a case main body storing a toner;

a rotator stored in the case main body and rotating around a rotation axis;

a transmitter transmitting rotation to the rotator, at least a part of the transmitter being arranged outside the case main body;

a cover moving along a rotation axis direction of the rotator between a covering position where the cover covers an outer circumference of the transmitter and an exposing position where the cover exposes the transmitter;

a biasing member biasing the cover to the covering position;

a shutter moving along the rotation axis direction between a closing position where the shutter closes a toner discharge port provided in the case main body and an opening position where the shutter opens the discharge port; and a link arranged outside the case main body and rotating around a fulcrum, wherein the cover and the shutter are connected via the link, as the cover moves from the covering position to the exposing position, the link is rotated in one direction to move the shutter from the closing position to the opening position, and as the cover moves from the exposing position to the covering position, the link is rotated in an opposite direction to the one direction to move the shutter from the opening position to the closing position.

2. The toner case according to claim 1, wherein the link includes:

a first arm part extending from the fulcrum to one side and engaging with the cover; and a second arm part extending from the fulcrum to another side and engaging with the shutter.

3. The toner case according to claim 2, wherein the cover includes:

a circumferential wall covering the outer circumference of the transmitter in a state where the cover is in the covering position; and a first engaging piece arranged at an inside of the circumferential wall in the rotation axis direction and engaging with the first arm part, and the shutter includes:

a main plate opening and closing the discharge port; and a second engaging piece arranged at an outside of the main plate in the rotation axis direction and engaging with the second arm part.

4. The toner case according to claim 1, further comprising a restriction member rotating between a restricting position where the restriction member restricts moving of the cover from the covering position to the exposing position and a restriction releasing position where the restriction member permits the moving of the cover from the covering position to the exposing position.

5. The toner case according to claim 4, further comprising a holder arranged outside the case main body and holding the cover, wherein at least a part of the restriction member is covered with the holder.

6. The toner case according to claim 5, wherein the restriction member includes an elastically deformable elastic part, and when the restriction member rotates from the restricting position to the restriction releasing position, the elastic part comes into contact with the holder to be elastically deformed, and the restriction member is biased to the restricting position by elastic returning force of the elastic part.

7. The toner case according to claim 1, further comprising a holder arranged outside the case main body and holding the cover, wherein the cover includes a pair of guide grooves, and the holder includes a pair of hook parts engaged with the pair of guide grooves.

8. The toner case according to claim 7, wherein the holder includes:

a base plate provided along a plane crossing the rotation axis; and a circumferential plate protruding from the base plate to an inside in the rotation axis direction, wherein the pair of hook parts is provided on the circumferential plate.

9. An image forming apparatus comprising:

a toner case; and an attachment part to which the toner case is detachably attached, wherein the toner case includes:

a case main body storing a toner;

a rotator stored in the case main body and rotating around a rotation axis;

a transmitter transmitting rotation to the rotator, at least a part of the transmitter being arranged outside the case main body; and a cover moving along a rotation axis direction of the rotator between a covering position where the cover covers an outer circumference of the transmitter and an exposing position where the cover exposes the transmitter, the toner case is attached to the attachment part along an attachment direction parallel to the rotation axis direction, the transmitter includes a transmitting coupling, the cover covers an outer circumference of the transmitting coupling in a state where the cover is in the covering position and exposes the transmitting coupling in a state where the cover is in the exposing position, the attachment part includes:

a driving coupling rotated by rotation driving force from a driving source; and a casing storing the driving coupling, as the toner case is attached to the attachment part, the cover comes in contact with the casing, moving of the cover to a downstream side in the attachment direction is restricted, the case main body moves to the downstream side in the attachment direction with respect to the cover from a position where the cover is arranged in the covering position to another position where the cover is arranged in the exposing position, and the transmitting coupling is coupled to the driving coupling.

10. The image forming apparatus according to claim 9, wherein the cover includes a first engaging part at a different position for every type of the toner case, the attachment part includes a second engaging part at a different position for every type of the attachment part, and when the type of the toner case matches the type of the attachment part, the first engaging part is engaged with the second engaging part and attaching of the toner case to the attachment part is permitted.

11. An image forming apparatus comprising:

a toner case; and an attachment part to which the toner case is detachably attached, wherein the toner case includes:

a case main body storing a toner;

a rotator stored in the case main body and rotating around a rotation axis;

a transmitter transmitting rotation to the rotator, at least a part of the transmitter being arranged outside the case main body;

a cover moving along a rotation axis direction of the rotator between a covering position where the cover covers an outer circumference of the transmitter and an exposing position where the cover exposes the transmitter; and a restriction member rotating between a restricting position where the restriction member restricts moving of the cover from the covering position to the exposing position and a restriction releasing position where the restriction member permits the moving of the cover from the covering position to the exposing position, as the toner case is attached to the attachment part, a pressing part provided in the attachment part presses the restriction member and the restriction member rotates from the restricting position to the restriction releasing position.

* * * * *